US006210135B1

(12) United States Patent
Rassin et al.

(10) Patent No.: US 6,210,135 B1
(45) Date of Patent: Apr. 3, 2001

(54) INTERNAL COMBUSTION ROTARY ENGINE

(76) Inventors: Valery Rassin, 2110 Salisbury Rd., Silver Spring, MD (US) 20910; Leonid Borukhov, 7605 Lorry La., Baltimore, MD (US) 21208

( * ) Notice: Subject to any disclaimer, the term of this patent is extended or adjusted under 35 U.S.C. 154(b) by 0 days.

(21) Appl. No.: 09/010,501

(22) Filed: Jan. 21, 1998

Related U.S. Application Data

(60) Provisional application No. 60/065,752, filed on Nov. 20, 1997.

(51) Int. Cl.[7] ..... F01C 1/00

(52) U.S. Cl. ..... 418/36; 418/34; 418/91; 418/88; 92/177

(58) Field of Search ..... 418/34, 91, 88, 418/36, 37; 92/177

(56) References Cited

U.S. PATENT DOCUMENTS

| | | | | |
|---|---|---|---|---|
| 1,303,255 | | 5/1919 | Carter . | |
| 1,676,211 | | 7/1928 | Rullington . | |
| 1,839,275 | * | 1/1932 | Sweningson | 418/34 |
| 2,612,878 | | 10/1952 | Wilson . | |
| 3,178,103 | | 4/1965 | Schnacke . | |
| 3,500,798 | | 3/1970 | Arnal . | |
| 3,736,080 | * | 5/1973 | Sabet | 418/34 |
| 3,955,541 | * | 5/1976 | Seybold | 418/34 |
| 3,989,012 | | 11/1976 | Doundoulakis . | |
| 5,051,065 | * | 9/1991 | Hansen | 418/269 |
| 5,324,182 | | 6/1994 | Sabet et al. . | |

FOREIGN PATENT DOCUMENTS

| | | |
|---|---|---|
| 622432 | 5/1949 | (GB) . |

* cited by examiner

*Primary Examiner*—Thomas Denion
*Assistant Examiner*—Thai-Ba Trieu

(74) *Attorney, Agent, or Firm*—I. Zborovsky

(57) ABSTRACT

An internal combustion rotary engine includes a stationary, centrally located manifold having an intake and an exhaust port. Inner and outer rotor assemblies are provided which rotate in a common direction about the centrally located manifold. Each of the inner and outer rotor assemblies includes two pairs of diametrically opposed pistons, generally of octagonal shape which divide a rotating internal volume, defined by the outer rotor assembly, into four working chambers. Pistons of the inner rotor assembly slide along related walls of the outer rotor assembly and by this arrangement, the four working chambers communicate periodically with the intake and exhaust ports. Angular movement of the inner rotor assembly against the outer rotor assembly ensures that each working chamber is at minimum volume and at a maximum volume four times per revolution of a crankshaft of the engine. When diametrically opposed working chambers are at their maximum volume, the two other diametrically opposed working chambers are at their minimum volume. Movement of the rotor assemblies and transfer of forces generated during operation of the engine is accommodated by a force transmitting mechanism. The mechanism includes a crankshaft, a main crank member, connecting links, and timing gear structure. The timing gear structure controls the rotation of the main crank member around crankshaft at an angle equal to the angle of rotation of the crankshaft. The engine has an efficient cooling system which provides cooling of all rotating and stationary parts that are heated or contacted by the combustion process. An important feature of the invention is the provision of an internally located water pump or impeller driven by the crankshaft. The pistons are liquid-cooled along with housings of the inner an outer rotor assemblies. The engine also has a lubricating system which not only provides lubrication for moving parts, e.g., bearings, etc., but in addition, provides oil flow along piston sealing lines. Oil flows along chevrons defined in the pistons to seal piston contact surfaces. Oil is returned to an oil drain via passages in the outer rotor assembly.

34 Claims, 28 Drawing Sheets

| POSITION | BETWEEN PISTONS | A<br>$84A_1$&$100B_1$ | B<br>$100B_1$&$84A_2$ | C<br>$84A_2$&$100B_2$ | D<br>$100B_2$&$84A_1$ |
|---|---|---|---|---|---|
| 1 | 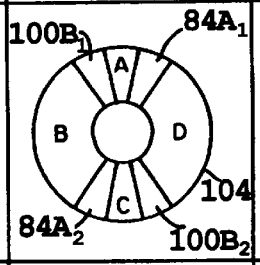 | IGNITION (POWER) | START OF COMPRES-SION | START OF AIR/FUEL INTAKE | START OF EXHAUST |
| 2 | 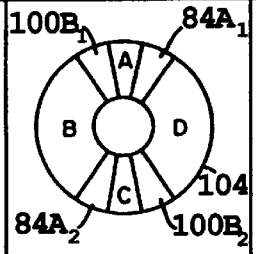 | EXPANSION (POWER) | COMPRES-SION | AIR/FUEL INTAKE | EXHAUST |
| 3 | 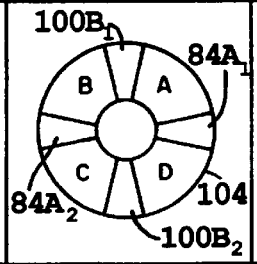 | EXPANSION (POWER) | COMPRES-SION | AIR/FUEL INTAKE | EXHAUST |
| 4 | 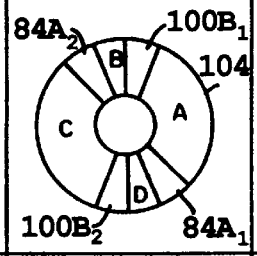 | EXPANSION (POWER) | COMPRES-SION | AIR/FUEL INTAKE | EXHAUST |
| 5 | 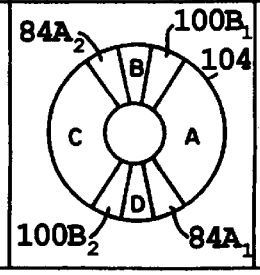 | END OF EXPANSION (POWER) | END OF COMPRES-SION | END OF AIR/FUEL INTAKE | END OF EXHAUST |

FIG. 20

Position at TDC
$\varphi=0°$
$\varphi=360°$ $\varphi$ = Angle of crankshaft 20 rotation Position at TDC
$\varphi=90°$ Position at TDC
$\varphi=180°$ Position at TDC
$\varphi=276°$

INTERNAL COMBUSTION ROTARY ENGINE

This application claims benefit of Application Provisional Ser. No. 06/065,752, filed Nov. 20, 1997.

BACKGROUND OF THE INVENTION

The present invention relates to a unconventional displacement engine of the rotary type, and more particularly to a rotary engine having an improved force transfer mechanism, an improved rotor assembly with effective cooling, sealing and lubrications systems, and a multifunctional manifold.

In conventional internal combustion engines heat energy is converted to translating or reciprocal mechanical energy of pistons which is then converted to rotational energy that drives a drive shaft. Piston rings are provided as contact surfaces between the piston and cylinder walls. The rings seal the lower portion of a combustion chamber to retain compression, scrape excess oil from the cylinder walls and to transfer heat from the piston to the cylinder walls. Approximately 50% of all mechanical losses are attributed to the piston rings, and about one-half of these are attributed to oil scraping. Mechanical loss due to friction results in less heat being used for power generation.

In addition, the structural design of the conventional engine does not facilitate easy modification. For example, it is not possible to change engine displacement by changing sizes of engine components. Generally, a family of engines having different numbers of cylinders and different displacements are provided.

A currently commercially available rotary engine, such as the Wankel engine is compact, lightweight, simple in design and capable of producing high power relative to its size with high mechanical loss. However, the Wankel engine is not fuel efficient because of inherent problems due to the shape of the pistons, and poor heat transfer due to inadequate cooling of the rotating members.

A variety of rotary piston engines have been proposed recently to improve the Wankel engine by altering the piston shape and the mechanism that ensures proper movement of the pistons. One such engine is disclosed in U.S. Pat. No. 5,133,317 to Sakita which discloses a rotary engine having an eccentric elliptical gear assembly interconnected with the rotating piston assemblies. However, with this configuration, the teeth of the gear assembly may experience most of the internal forces generated during combustion and may fail. Further, the gear assembly is generally not compact, has many moving parts which contribute to mechanical loss, and may be expensive to manufacture and maintain.

SUMMARY OF THE INVENTION

An object of the present invention is to provide a new internal combustion rotary engine having a centrally located manifold, an improved force transfer mechanism which reduces internal forces, an efficient cooling system, and a lubrication system which not only lubricates moving parts, but also seals piston contact surfaces.

In accordance with the principles of the invention, this object is attained by providing an internal combustion rotary engine including a stationary, centrally located manifold having an intake and an exhaust port. Inner and outer rotor assemblies are provided which rotate in a common direction about the centrally located manifold. Each of the inner and outer rotor assemblies includes two pairs of diametrically opposed pistons, generally of octagonal shape which divide a rotating internal volume, defined by the outer rotor assembly, into four working chambers. Pistons of the inner rotor assembly slide along related walls of the outer rotor assembly and by this arrangement, the four working chambers communicate periodically with the intake and exhaust ports. Angular movement of the inner rotor assembly against the outer rotor assembly ensures that each working chamber is at minimum volume and at a maximum volume four times per revolution of a crankshaft of the engine. When diametrically opposed working chambers are at their maximum volume, the two other diametrically opposed working chambers are at their minimum volume.

The working stroke of the engine is defined as a maximum angle between two adjacent pistons. This maximum angle defines an arc length which is equivalent to the stroke of a conventional engine.

Movement of the rotor assemblies and transfer of forces generated during operation of the engine is accommodated by a force transmitting mechanism. The mechanism includes a crankshaft, a main crank member, connecting links, and timing gear structure. The timing gear structure controls the rotation of the main crank member around crankshaft at an angle equal to the angle of rotation of the crankshaft. Rotation of the crankshaft may occur in the same direction as rotation of the rotor assemblies, or may occur in the opposite direction, depending on the particular arrangement of the engine.

The engine has an efficient cooling system which provides cooling of all rotating and stationary parts that are heated or contacted by the combustion process. An important feature of the invention is the provision of an internally located water pump or impeller driven by the crankshaft. Depending on the arrangement of the engine, the impeller may rotate in a direction opposite to a direction of rotation of the rotor assemblies, or may rotate in the same direction as the rotor assemblies. The pistons are liquid-cooled along with housings of the inner an outer rotor assemblies via water drawn into the engine by the impeller.

The engine also has a lubricating system which not only provides lubrication for moving parts, e.g., bearings, etc., but in addition, provides oil flow along piston sealing lines. Oil flows along chevrons defined in the pistons to seal piston contact surfaces. Oil is returned to an oil reservoir via passages in the outer rotor assembly. The shape of pistons of the inner rotor assembly is defined for proper oil drainage.

Another object of the present invention is the provision of a device of the type described which is simple in construction, effective in operation and economical to manufacture and maintain.

These and other objects of the present invention will become apparent during the course of the following detailed description and appended claims.

BRIEF DESCRIPTION OF THE DRAWINGS

FIG. 20 is a chart that schematically illustrates a portion of the sequence of operation of the engine;

DETAILED DESCRIPTION OF THE PRESENTLY PREFERRED EXEMPLARY EMBODIMENT

Figure 1A:
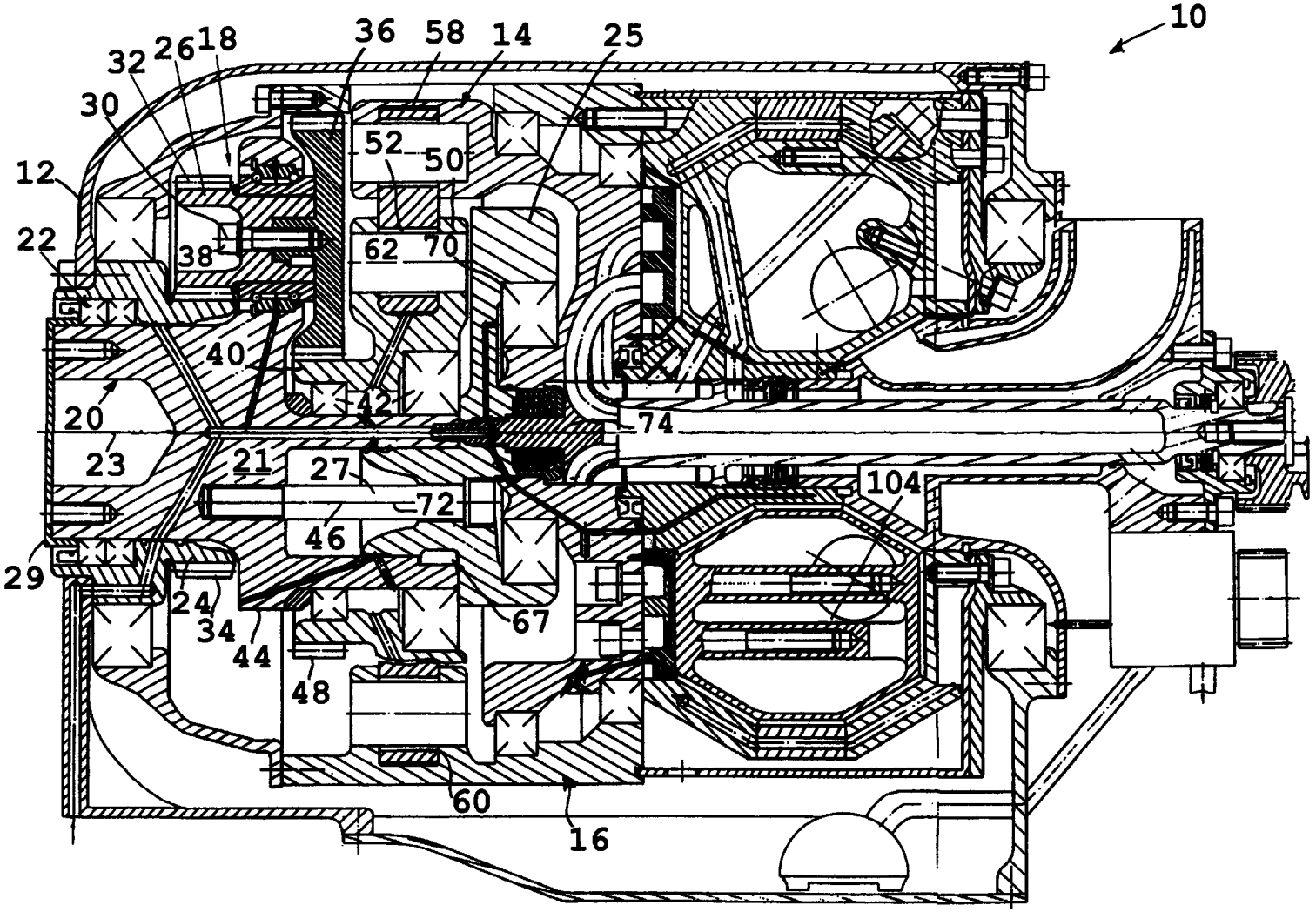
FIGS. 1A and 1B are a schematic illustrations of an internal combustion rotary engine provided in accordance with the principles of a first embodiment of the present invention.
Figure 1B:
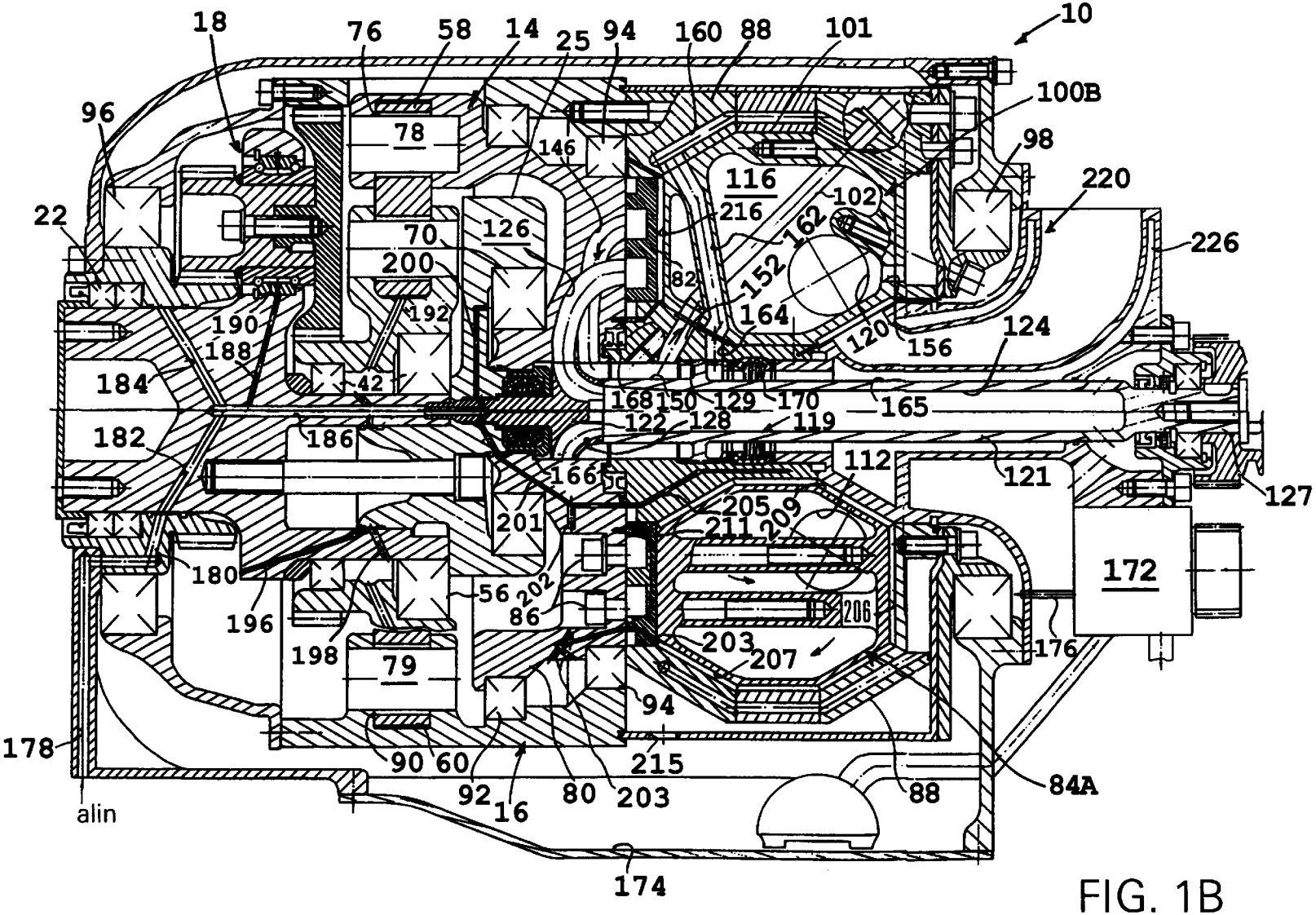

With reference to FIGS. 1A and 1B, which are identical, a first embodiment of an internal combustion rotary engine is shown, generally indicated at 10, which embodies the principles of the present invention. FIG. 1A will be used to describe a force transfer mechanism, while FIG. 1B will be used to describe rotor assemblies, and oil and water distribution. It is noted that the right hand portion of FIGS. 1A and 1B are sectional views of pistons of the engine, the pistons being disposed in different planes.

As shown in FIG. 1A, the engine includes a housing 12. A first rotor assembly, generally indicated at 14, and a second rotor assembly, generally indicated at 16, are mounted for rotational movement within the housing 12. The engine also includes a force transfer mechanism, generally indicated at 18, for controlling the relative movement of the rotor assemblies.

Figure 2:
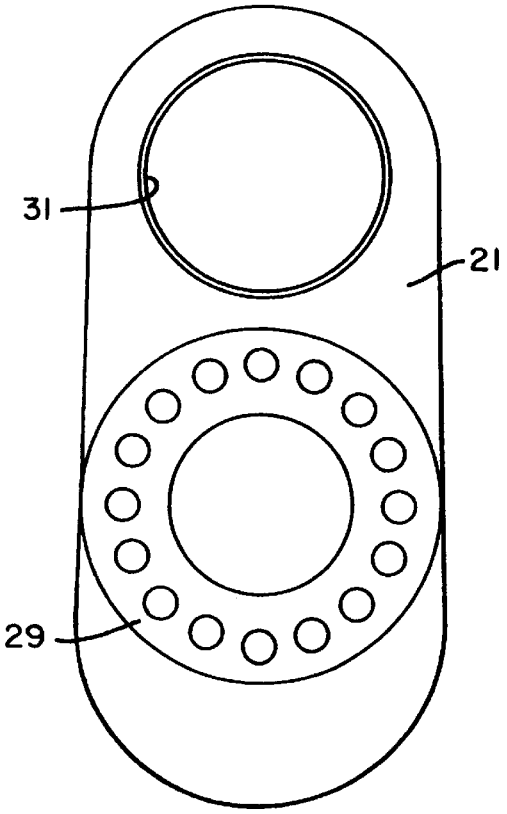
FIG. 2 is an front view of the main portion of crankshaft structure of the engine.

With reference to FIG. 1A, the components of the mechanism 18 include crankshaft structure, generally indicated at 20, that is rotatably supported by bearing structure 22 fixed to the housing 12. The crankshaft structure 20 is supported so as to rotate about a longitudinal axis 23 thereof and comprises a main portion 21 and a crank arm portion 25 coupled thereto via bolting 27. As shown in FIG. 2, the main portion 21 includes a connecting boss 29 and an opening 31 for receiving satellite gears, as will be explained below. A stationary gear 24 is fixed with respect to the housing 12 and is axially aligned with the longitudinal axis 23 of the crankshaft structure 20. A first satellite gear 26 is rotatably coupled to an extending portion of the crankshaft structure 20 at opening 31 for movement about an axis 30 of the satellite gear 26. The first satellite gear axis 30 is spaced from the longitudinal axis 23 and the first satellite gear 26 includes gear teeth 32 that are in meshing relation with teeth 34 of the stationary gear 24 so that the satellite gear 26 moves about the longitudinal axis 23 of the crankshaft structure 20. A second satellite gear 36 is coupled to the first satellite gear 26 by bolting 38 so as to be coaxial with the first satellite gear 26 to rotate in the same direction as the first satellite gear, and to move with the first satellite gear about the longitudinal axis 23.

Figure 4:
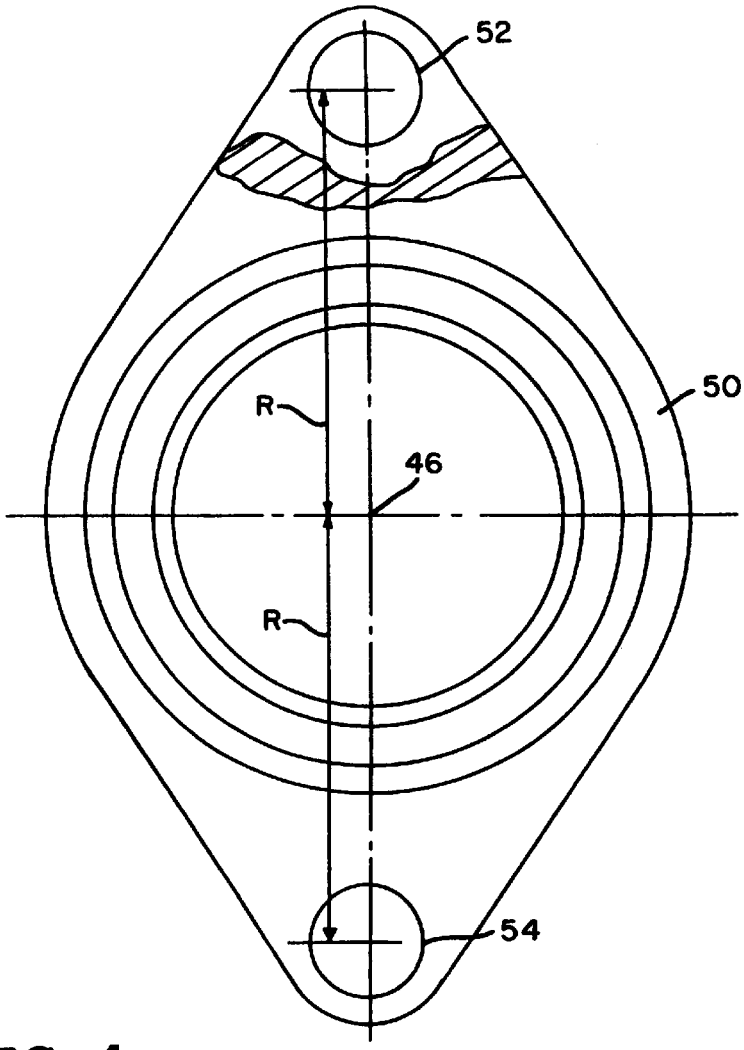
FIG. 4 is a front view of a crank member of the main crank assembly.

A main crank assembly 40 is supported via bearings 42 for rotation about shaft portion 44 of the crankshaft structure 20. The main crank assembly is mounted for rotational movement about an axis 46 of the shaft portion 44. As shown in FIG. 1A, the main crank assembly 40 includes a main gear 48 that is in meshing relation with teeth of the second satellite gear 36. The main crank assembly 40 also includes a crank member 50 operatively coupled with the main gear 48 and having diametrically opposed connection locations in the form of through holes 52 and 54. As best shown in FIG. 4, centers of the connection locations 52 and 54 are each located an equal radial distance R from the central rotational axis 46 thereof. The crank member 50 is supported by a bearings 42, as shown in FIG. 1A. The gears of the mechanism 18 are designed such that:

$$(n_3\ n_{5'})/(n_4\ n_5)=2,$$

where $n_3$ is the number of gear teeth on the stationary gear 24, $n_{5'}$ is the number of teeth on second satellite gear 36, $n_4$ is the number of teeth on the main gear 48, and $n_5$ is the number of teeth on the first satellite gear 26.

Although, in the illustrated embodiment, intermeshing gears are provided, it can be appreciated that other means of causing movement of the main crank assembly 40 could be provided. For example, instead of intermeshing gears, fluid couplings, sprockets and chains could be employed to facilitate the same movements.

As shown in FIG. 1A, first and second connecting links 58 and 60 are provided, with one end of each link being rotatably coupled to an associated connection location 52 and 54 of the crank member 50 via a pin connection 62. The links 58 and 60 are of equal length. Although only link 58 is shown connected to the crank member 50 in FIG. 1A due to the location where the cross-section was taken, it can be appreciated that link 60 is coupled to the crank member 50 is a manner identical to that of link 58.

Figure 3:
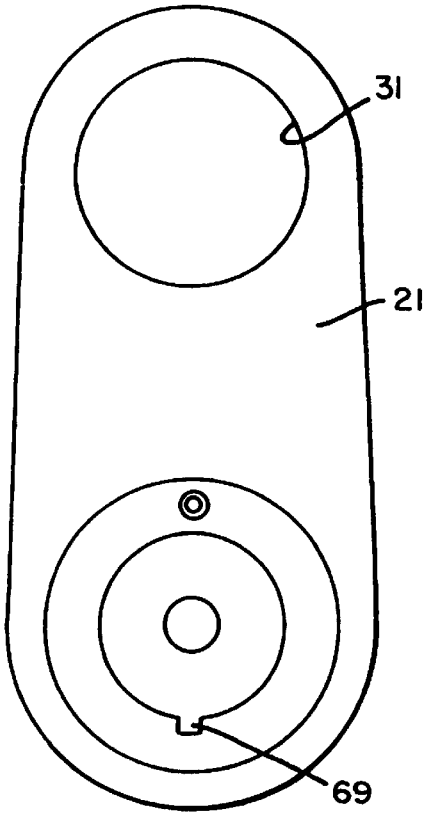
FIG. 3 is a rear view of the main portion of the crankshaft structure.
Figure 5:
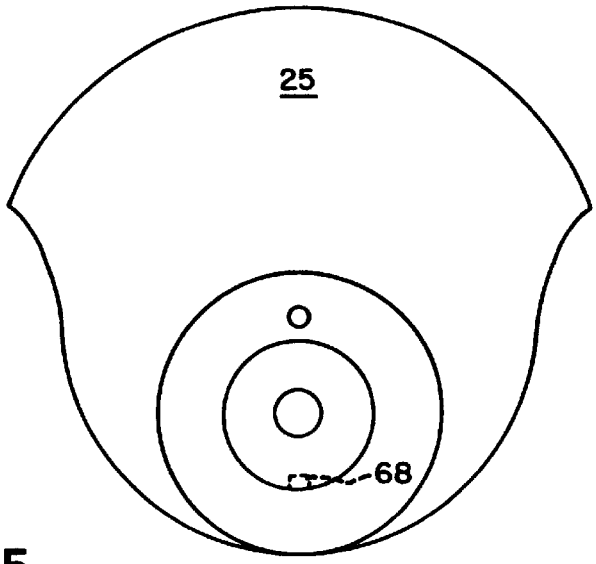
FIG. 5 is a front view of a crank arm portion of the crankshaft structure.

As shown in FIG. 1A, the crank arm portion 25 of the crankshaft structure 20 is coupled to the main portion 21 of the crankshaft structure 20 by bolting and a keyed connection, generally indicated at 67. With reference to FIGS. 3 and 5, the keyed connection is formed by providing a slot 68 in arm portion 25 and a recess 69 in main portion 21 which receive key 71 such that arm portion 25 is locked to and rotates with main portion 21. As shown in FIG. 1A, the crank arm portion 25 is supported for rotation by bearing 70 and has a first rotational axis 72 that is aligned with the main crank assembly axis 46 and a second rotational axis 74 that is spaced from the first axis 72 and aligned with the longitudinal axis 23 of the crankshaft structure 20. The crank arm portion 25 is operatively associated with the main crank assembly 40 via shaft portion 44 so as to rotate about the main crank assembly axis 46.

Figure 6:
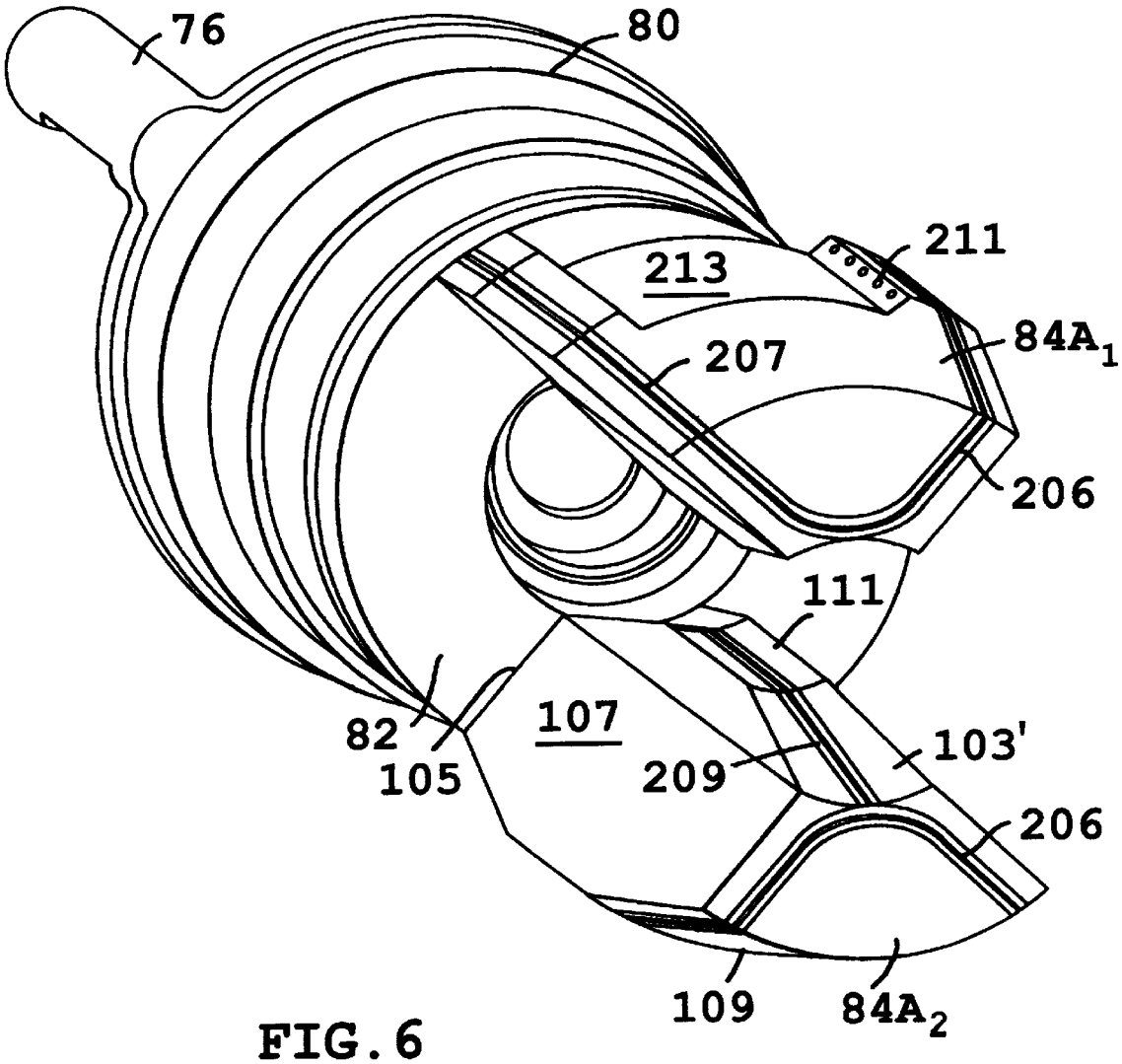
FIG. 6 is a perspective view of the first rotor assembly of the engine.
Figure 7:
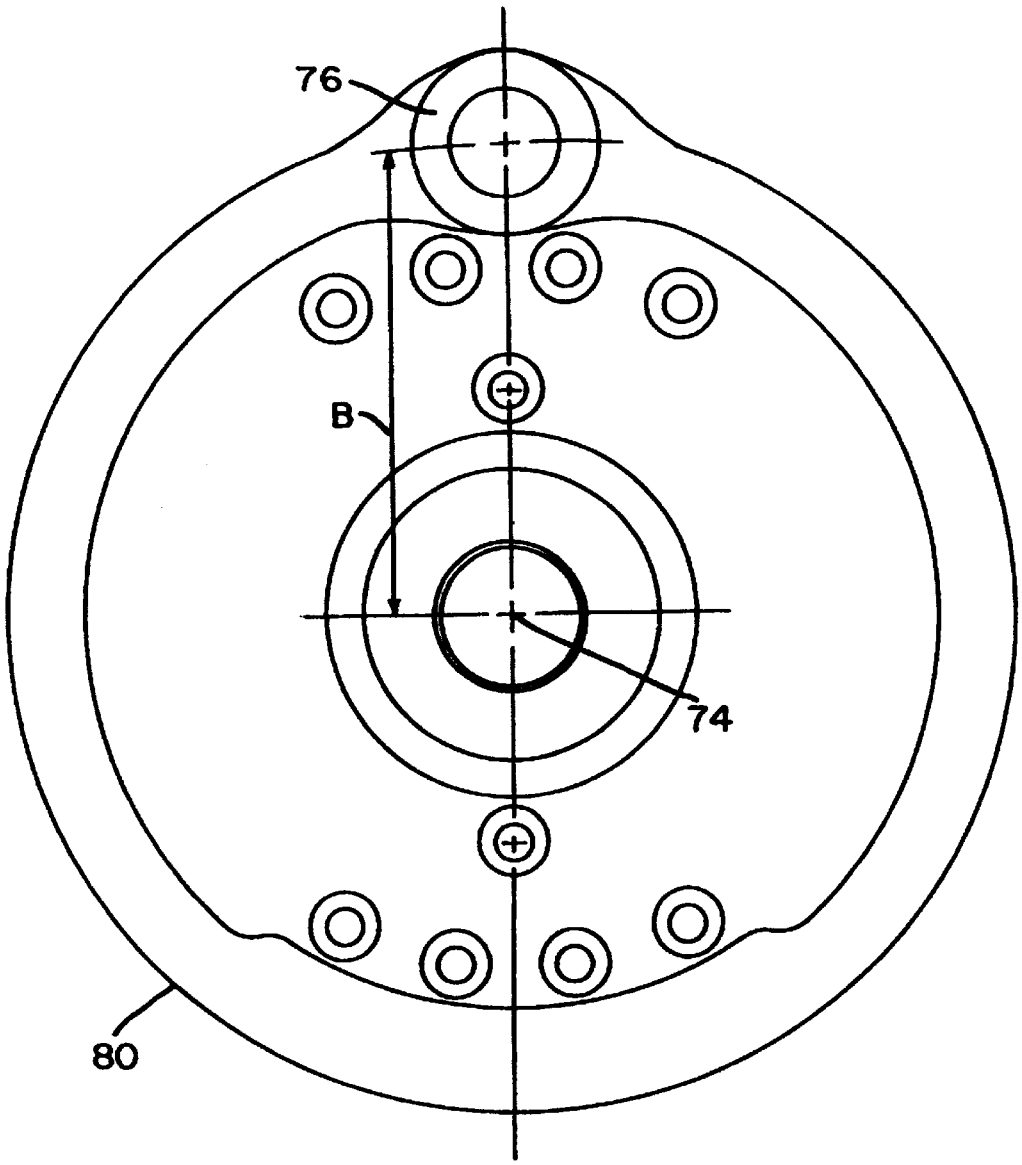
FIG. 7 is an end view of a connection disk of the first rotor assembly.

As shown in FIG. 1B, the first rotor assembly 14 is coupled to the crank arm portion 25 via bearing 70 so as to rotate about axis 74. As best shown in FIGS. 1B and 6, the first rotor assembly 14 comprises a rotatable body 80 defining connecting portion 76 and a cylindrical water distribution disk member 82 bolted to the body 80 on a face thereof opposite to the face where the connecting portion 76 is located. A center of the connecting portion 76 is located at a predetermined radial distance B (FIG. 7) from the longitudinal axis 23, which is common with axis 74. A second end of link 58 is rotatably coupled via a pin 78 to the connecting portion 76 of the first rotor assembly 14. A piston assembly including a pair of diametrically opposed, identically configured pistons 84$A_1$ and 84$A_2$ is coupled to the disk member 82 via bolts 86.

Figure 8:
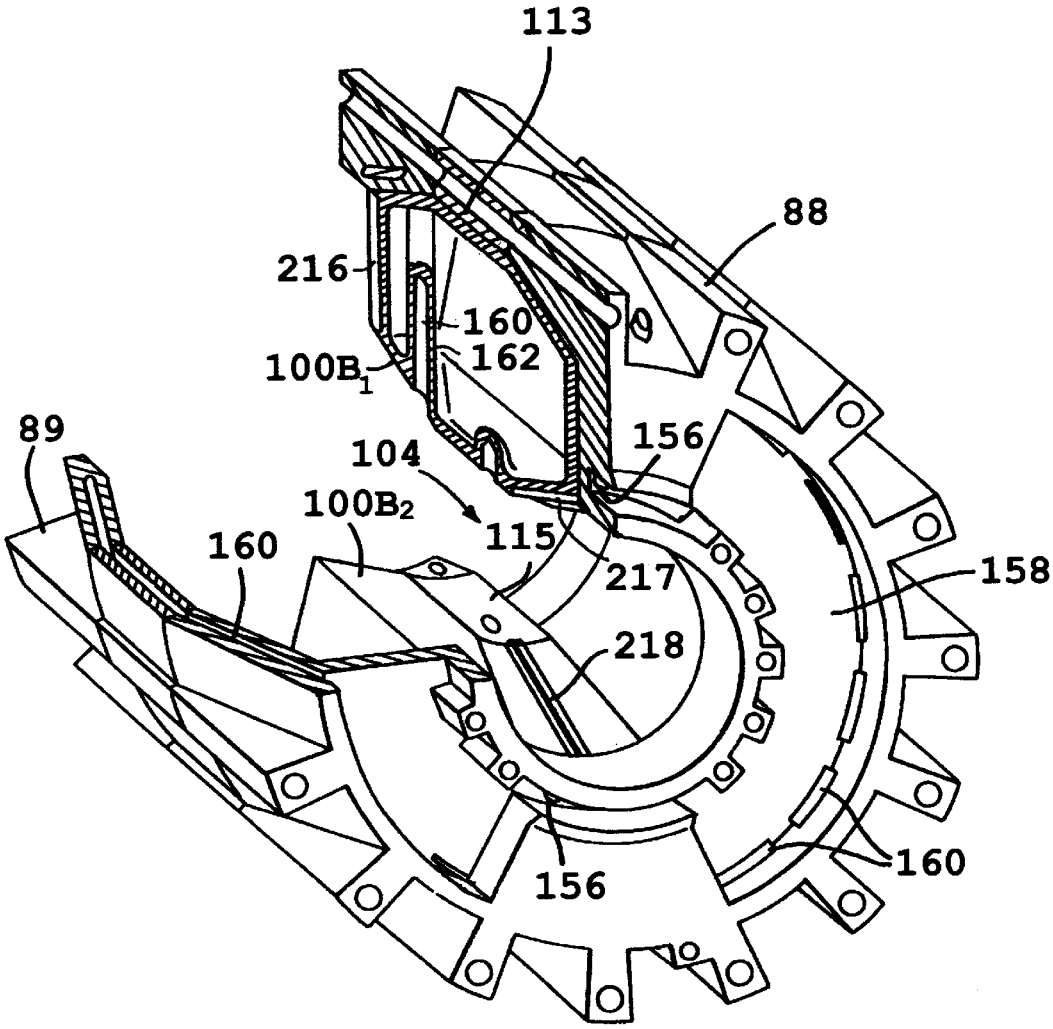
FIG. 8 is a partial perspective view of the second rotor assembly of the engine.
Figure 9:
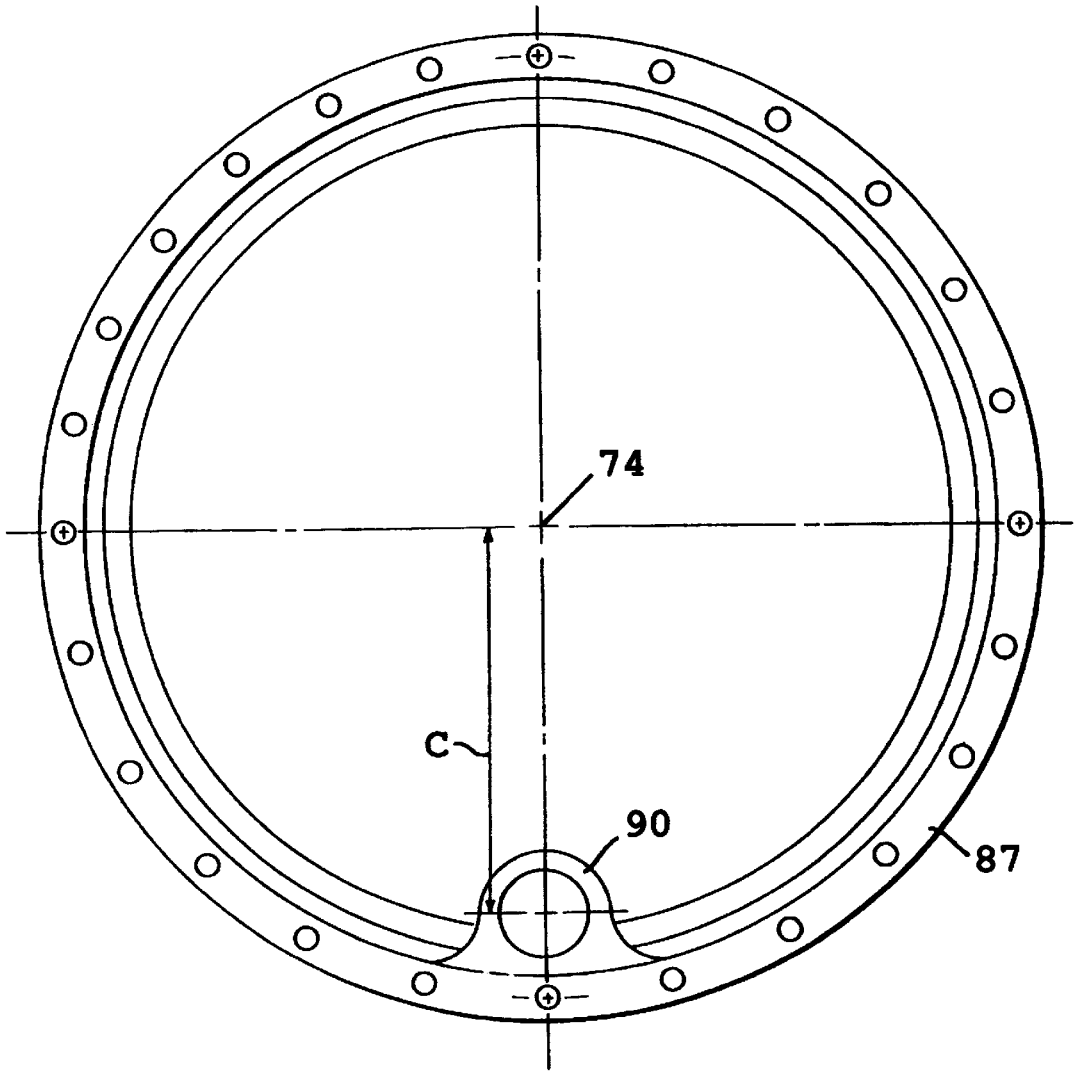
FIG. 9 is a front view of a connection member of the second rotor assembly.

As shown in FIG. 1B, the second rotor assembly 16 is oriented concentrically with the first rotor assembly 14 and is mounted for rotation about the axis 74 and thus the longitudinal axis 23. As best shown in FIGS. 1A and 8, the second rotor assembly 16 has a main body 88 in the form of a generally cylindrical drum defining an internal volume 104, which is a rotating displacement volume. The body 88 has a drum 87 (FIG. 9) coupled to end 89 thereof to defining a connecting portion 90. As seen in FIG. 9, a center of the connecting portion 90 is located a radial distance C from the second axis 74 and thus the longitudinal axis 23 that is equal to the radial distance B defined between the connecting portion 76 of the first rotating assembly and axis 74. A second end of the link 60 is rotatably coupled via a pin 79 to the connecting portion 90 of the second rotor assembly 16. In the illustrated embodiment, the first rotor assembly 14 is disposed within the internal volume 104 of drum body 88 and is mounted for rotation therein via bearings 92 and 94 (FIG 1B). The second rotor assembly 16 is mounted for rotation with respect to the housing 12 via bearings 96 and 98. In the embodiment, all bearings are conventional ball bearings that are selected for specific loads and size of the engine. It can be appreciated that any known type of bearings could be employed.

The second rotor assembly 16 includes a second piston assembly having a pair of diametrically opposed, pistons 100$B_1$ and 100$B_2$ coupled to an interior portion 101 of the drum body 88 via a plurality of bolts 102.

As best shown schematically in FIG. 20, pistons 100$B_1$, 100$B_2$ divide the internal volume 104 into two sections, and the two sections are in turn each divided into two working chambers by pistons 84$A_1$, 84$A_2$. Thus, pistons 84$A_1$, 84$A_2$ and 100$B_1$, 100$B_2$ are oriented within the rotating internal volume 104 so as to divide the rotating internal volume 104 into two pairs of diametrically opposite working chambers A and C, B and D. As will become apparent below, the pistons assemblies operate at periodically variable speeds such that periodically variable volume working chambers are provided between adjacent pistons.

Figure 10:
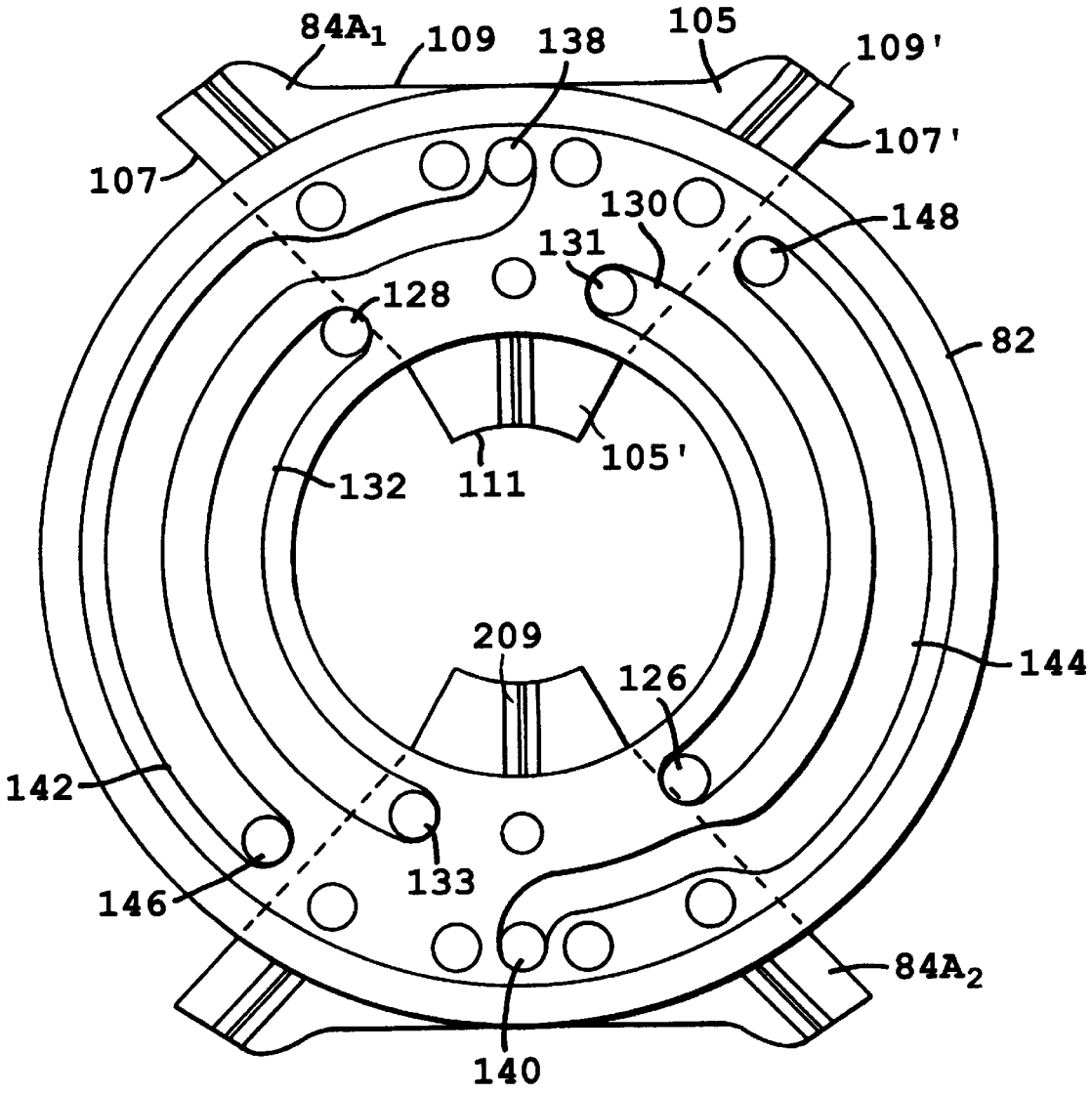
FIG. 10 is a rear view of a distribution disk of the first rotor assembly.
Figure 11B:
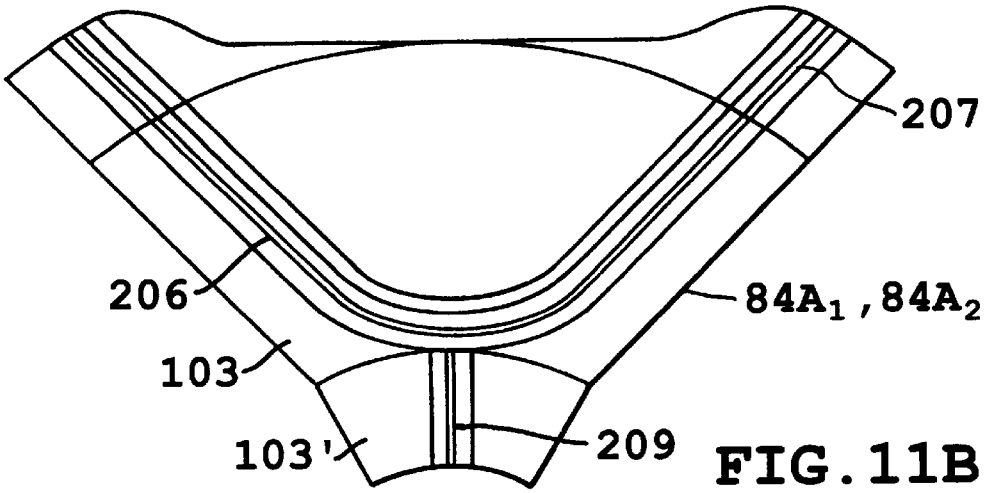
FIG. 11B is a front view of a piston of the first rotor assembly.
Figure 11A:
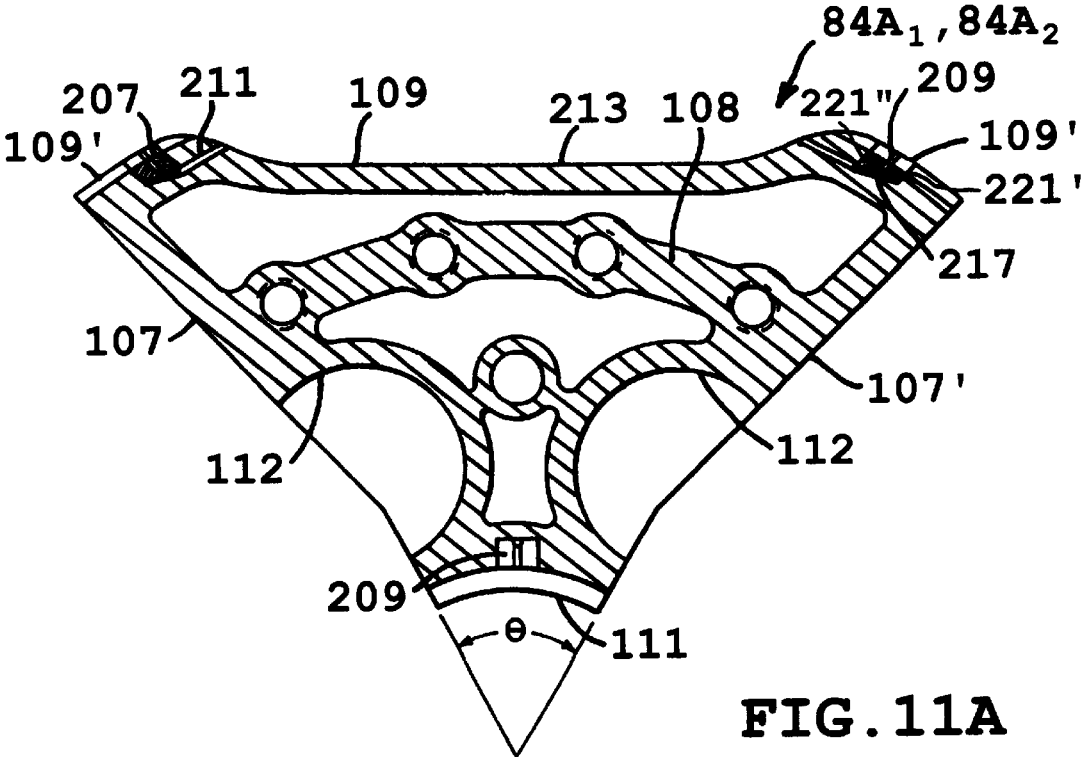
FIG. 11A is a sectional view of a piston of the first rotor assembly.
Figure 12:
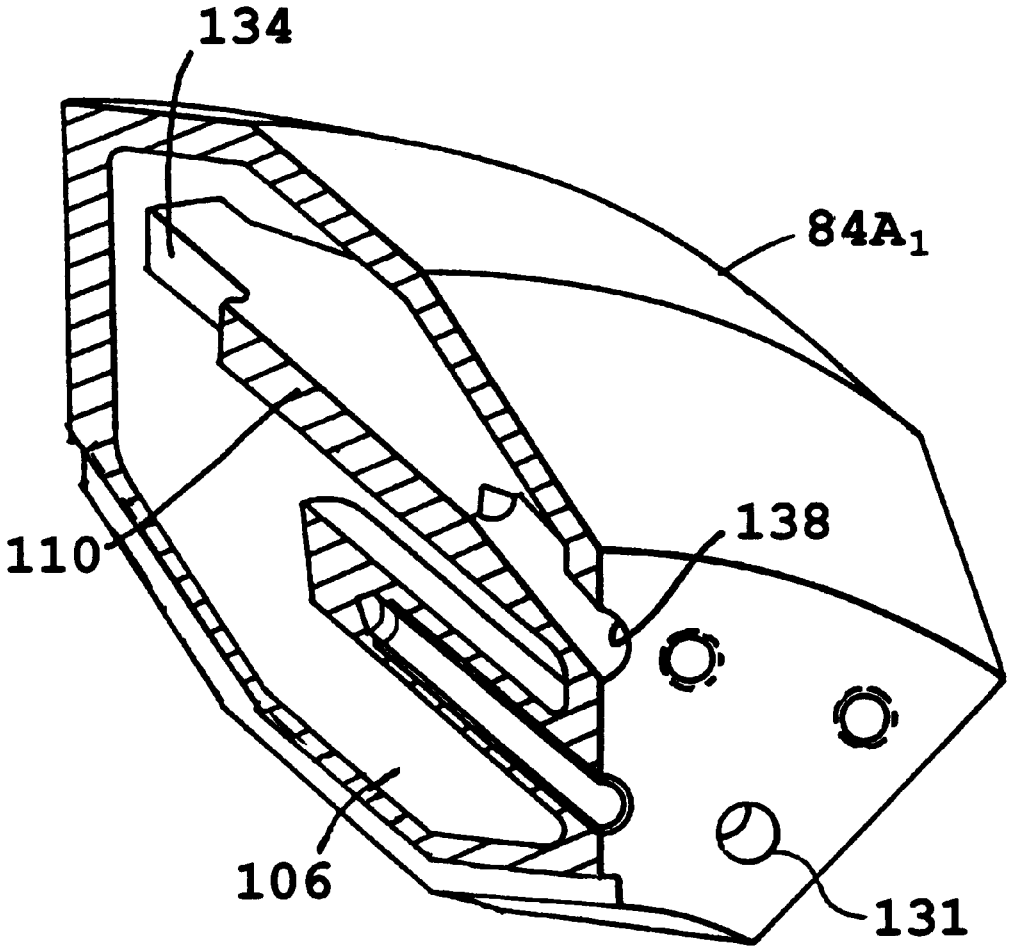
FIG. 12 is a perspective view, partially in section, of a piston of the first rotor assembly.

As best shown in FIGS. 6, 10 and 11A, pistons 84$A_1$ and 84$A_2$ have a front face 103 including a curved portion 103', an opposing rear face 105 including curved portion 105', opposing sidewalls 107 and 107', top surfaces 109 and 109' and a curved bottom surface 111, joined to define an interior volume 106. Surfaces 109' slide on the interior surface of body 88 of the second rotor assembly 16 during operation of the engine 10. Boss 108 (FIG. 11A) is provided having bolt holes for coupling the pistons to the disk 82 (FIG. 10), and a water separator 110 is defined internally (FIG. 12). As shown in FIG. 11, opposing sidewalls 107 each include a part-spherical recess 112, the function of which will become apparent below. The shape of pistons 84$A_1$ and 84$A_2$ provides the following advantages: port possibilities for spark plugs or injection devices, the angled shapes simplifies manufacturing, and there is minimum surface area to be sealed which reduces friction and heat losses which means that the exhaust port can be opened much later in the cycle.

Figure 27:
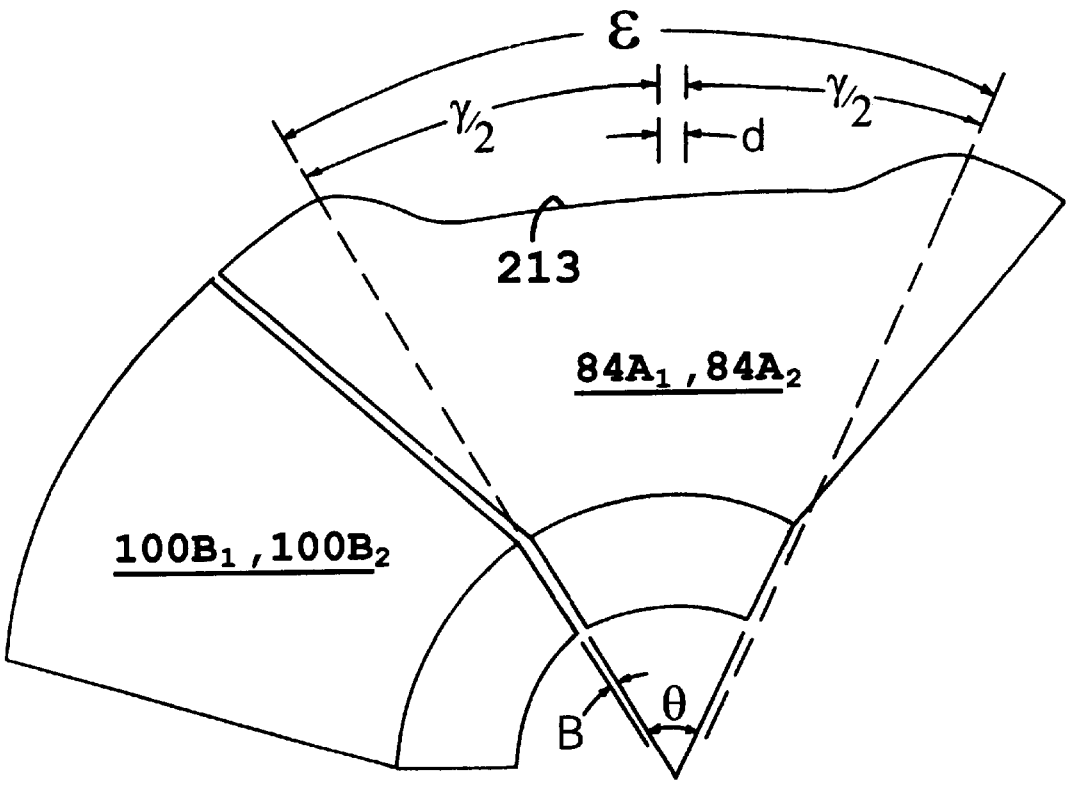
FIG. 27 is a view of a pair of pistons of the invention showing a design angle and an angle of an opening defined in a top portion of one of the pistons of the pair.

An important feature of pistons 84$A_1$ and 84$A_2$ is opening or recess 213 (FIG. 6) therein for the collection and disposal of excessive oil through oil drainage holes 215 in body 88, as will become more apparent below. For this reason, with reference to FIG. 27, the angle $\epsilon$ of the opening 213 is:

$$\varepsilon = \gamma + \frac{(d \cdot 360)}{(2\pi R_{pr})}$$

where d is the diameter of the drain holes, $R_{pr}$ the outer radius of the piston (profile radius).

Figure 15:
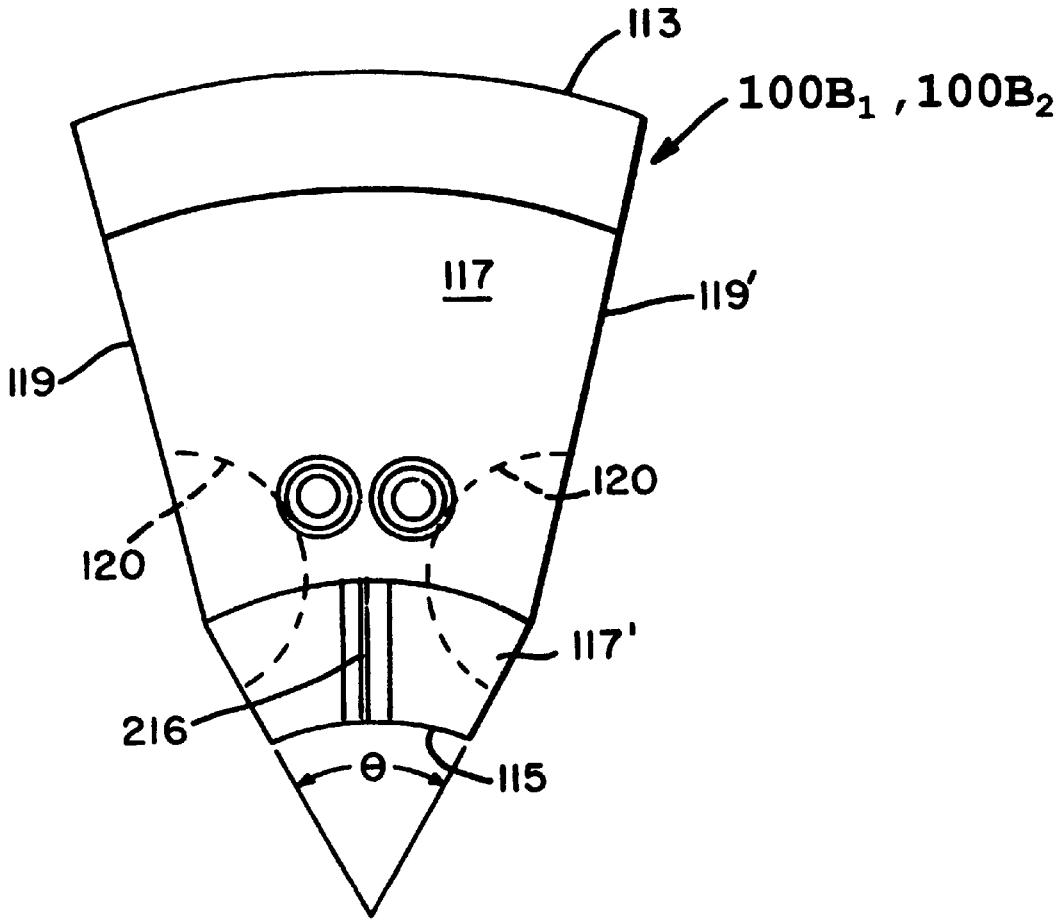
FIG. 15 is a front view of a piston of the second rotor assembly.
Figure 16:
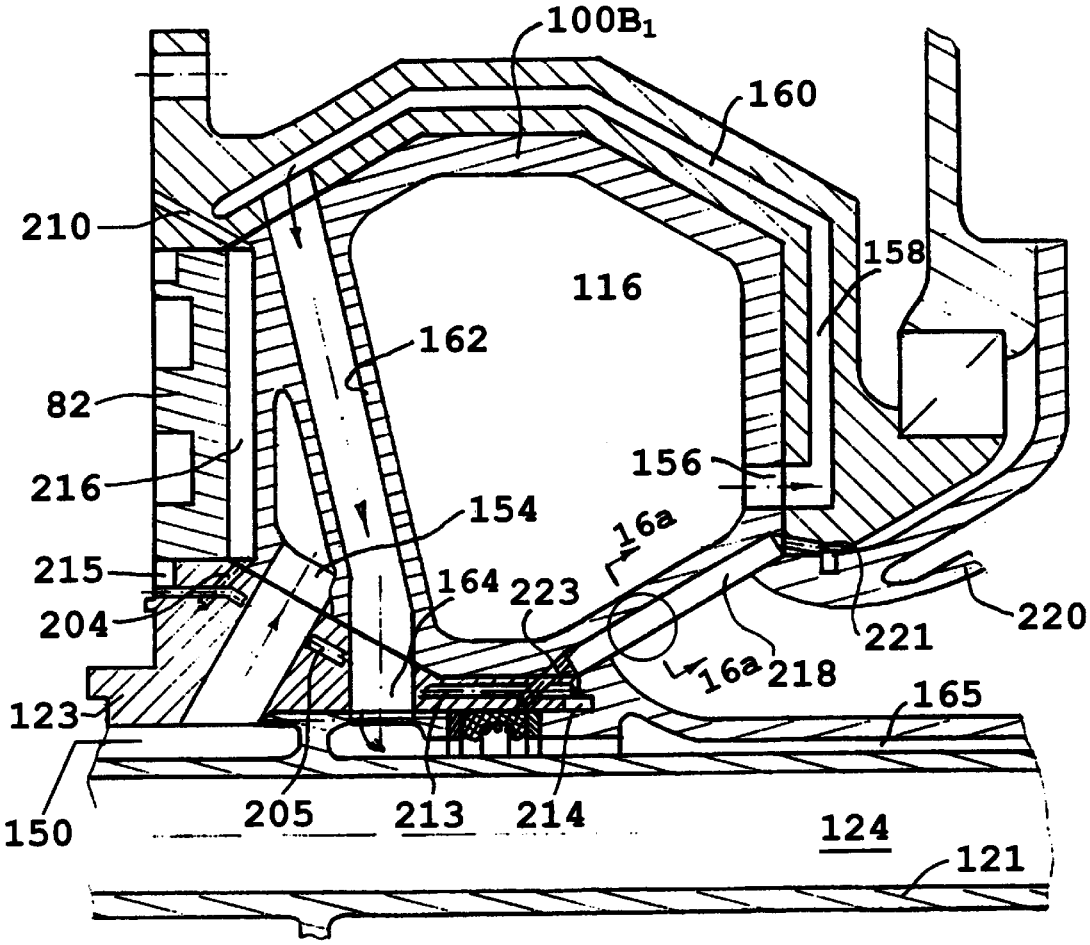
FIG. 16 is a view of pistons of the second rotor assembly, shown partially in section to indicate oil flow paths.

As best shown in FIGS. 15 and 16, pistons 100$B_1$ and 100$B_2$ have a top surface 113, a bottom surface 115, a front surface 117 including curved portion 117' and an opposing rear surface, and opposing sidewalls 119 and 119', joined to define an interior volume 116. Opposing sidewalls 119 and 119' each include a part-spherical recess 120 which mates with a corresponding recess 112 in the pistons 84$A_1$ and 84$A_2$ when pistons 84A and 100B are adjacent, to form a spherical combustion chamber during rotation of the pistons 84A and 100B. In the illustrated embodiment, approximately three-fourths of the volume of the combustion chamber is formed from recess 120. Each sidewall of the pistons 84A and 100B which mate to form a combustion chamber is generally octagonal in shape having eight edges which approaches a circular shape and is simple to manufacture. It is noted that the pistons are designed so as to be thermally compensated. Thus, as the engine heats, the combustion chamber formed by the recesses 120 and 112 in the pistons 100B and 84A will take its spherical configuration. The spherical combustion chambers have a small surface area which heats thus, less heat transfer therefrom is required. As discussed above, pistons 100B and 84A in FIG. 1B are shown to be in the same plane for illustrative purposes only. It can be appreciated that pistons 100B and 84A are in different planes in FIGS. 1A and 1B.

With reference to the figures, particularly FIGS. 1A and 13, the operation of the mechanism 18 which ensures movement of the pistons 84$A_1$ 84$A_2$, 100$B_1$ and 100$B_2$, at periodically variable speeds will be appreciated. FIG. 13 schematically shows the positional relationships during various degrees of rotation of the mechanism 18 between the radius B taken from the longitudinal axis 23 (point P in FIG. 13A) to the connecting portion 58 of rotor assembly 14, the radius C taken from the longitudinal axis 23 (point P) to the connecting portion 90 of rotor assembly 16, the radius R of crank member 50 taken from the axis 46 (point T in FIG. 13A) to a connection location 52 of crank member 50, and the radius F taken from axis 23 to axis 46 (from point P to point T in FIG. 13A). As shown, when crank arm portion 25 (and crankshaft structure 20) moves in one direction about the longitudinal axis 23 (point P), the main crank assembly including crank member 50 moves in the opposite direction about the longitudinal axis 46. Since the connecting links 58 and 60 couple the crank member 50 to an associated rotor assembly 14 and 16, the rotor assemblies 14 and 16 move in the same direction relative to each other at periodically various speeds and move about the longitudinal axis 23 in a direction opposite to the direction of rotation of the crank arm portion 25 of the crankshaft structure 20.

It can be appreciated with reference to FIGS. 1B, 13A–13J that the mechanism 18 ensures that for any degree of rotation of the crank arm portion 25 (represented as radius F), there is an equal degree of rotation against the crank arm portion. FIGS. 3A–13J also clearly show that the crank arm portion 25 and the crank member 50 rotate in opposite directions. These relationships hold true throughout a full rotation of the mechanism 18 since the radial lengths B and C between the longitudinal axis of rotation 23 and the connecting portions 76 and 90 are equal, the radial length between the axis of rotation 23 and the connection locations 52 and 54 of the crank member 50 are equal, and since the links 58 and 60 have equal length. It can be appreciated then that since the rotor assemblies 14 and 16 are coupled to associated piston assemblies, the piston assemblies move at periodically variable speeds. This occurs since the axis 46 of the main crank assembly 40 is spaced or offset from the longitudinal axis 23. Thus, since the crankshaft structure 20 is rotating at a constant speed, as the radial distance between the connection locations 52 and 54 and the longitudinal axis 23 increases, the speed of the rotor assembly (and thus pistons) connected at that location decreases, and as the above-mentioned radial distance decreases, the speed of the rotor assembly (and thus pistons) disposed at the short radial length connection location increases, thereby providing variable speed movement of the rotor assemblies 14 and 16 during one revolution thereof.

Figure 24:
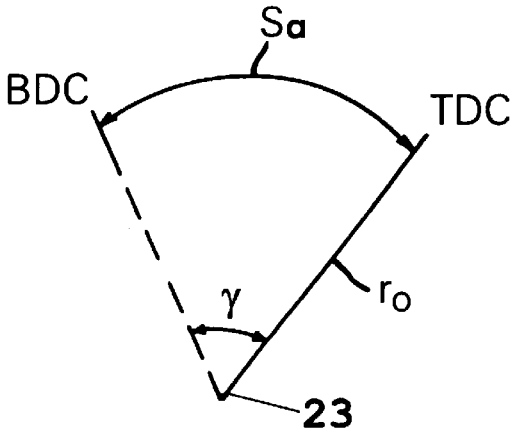
FIG. 24 is an illustration of the stroke of the engine of the invention.

To understand the "stroke" of the engine 10, an angle γ is defined as the maximum angle between two adjacent pistons 84A and 100B. This angle γ is the working angle and the length of an arc defined by γ is equivalent to the stroke of a conventional engine (FIG. 24). In the engine of the embodiment, γ is set at 64 degrees. It can be appreciated that γ is selected for the particular engine design and may be more that 64 degrees. For example, in the second embodiment of the invention (FIG. 28), γ is set at 71 degrees.

Figure 26:
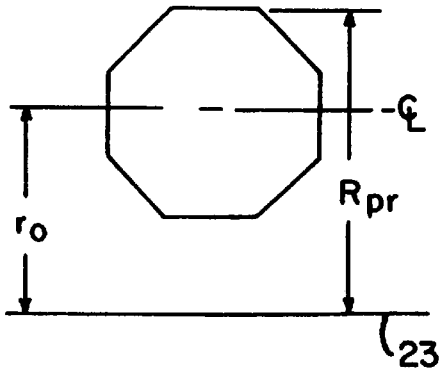
FIG. 26 is an illustration of a piston of the invention used to determine displacement of the engine.

With reference to FIGS. 24 and 26, the displacement of the engine will be appreciated. The displacement at each single chamber of the engine is:

$$V'=C_S \cdot S_a$$

where $C_S$ is the cross sectional area of the piston $S_a$ is the working stroke, $$S_a = \frac{2\pi r_0 \gamma}{360}$$

γ is the stroke angle (angle of the piston rotation between TDC and BDC).

The engine displacement is thus V=4V'. It can be appreciated that by manipulating γ, the displacement of the engine can be changed.

The piston angle θ (FIGS. 11 and 27) is calculated as follows:

$\theta=(360-(2-\gamma)-(4\cdot\beta))/4$, where β is a dead angle, the equivalent of the gap between a piston and cylinder head in a conventional engine and chosen for the particular design. Thus, in the illustrated embodiment, θ is the same for pistons 84A and 100B and is approximately in the range of 50–60 degrees which controls the timing of the engine.

Figure 25:
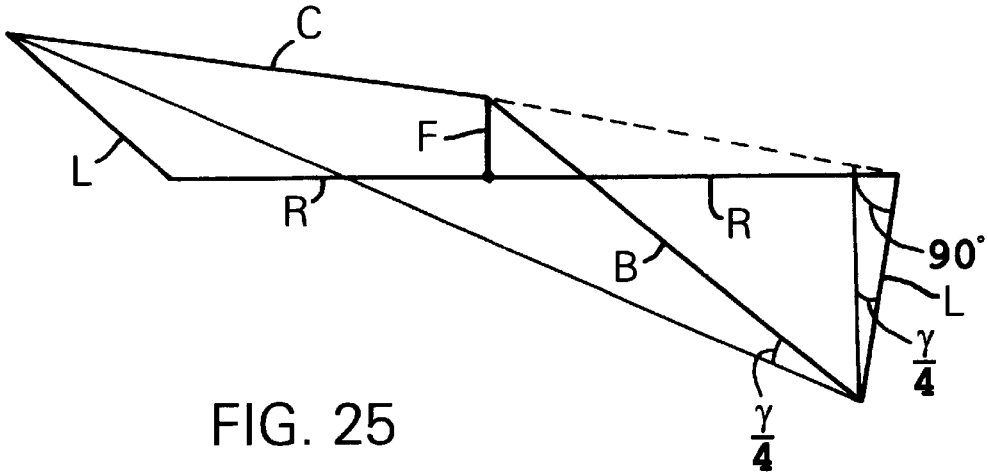
FIG. 25 is a schematic illustration of the mechanism of the invention showing the relationship between elements thereof.

Further, with γ chosen for rotor design and radius C=radius B being known, as shown in FIG. 25, the radius or length F can be determined by:

$$F=C-C/(1+\tan(\gamma/4)),$$

where $C/(1+\tan(\gamma/4))$ is a dimension of the crank member equal to R (see FIG. 4). Thus, F=C−R or $F=R\cdot\tan(\gamma/4)$.

In addition, the length of each connecting link 58 and 60 is determined by:

$$L=(C^2-(F^2+R^2))^{1/2}$$

Figure 13A:
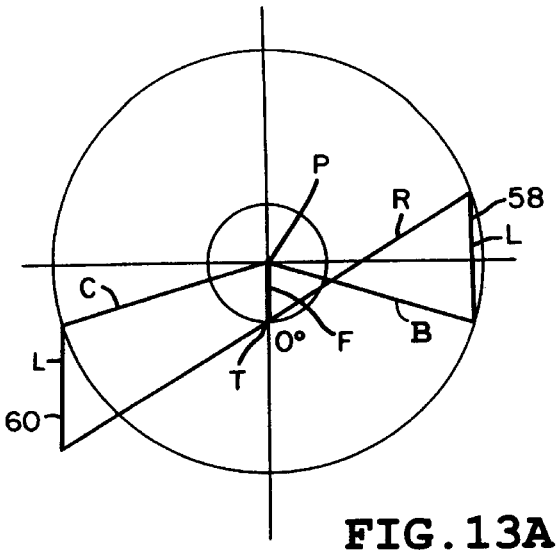
FIGS. 13A–13J are schematic illustrations of the mechanism of the invention shown at various positions of revolution.
Figure 13B:
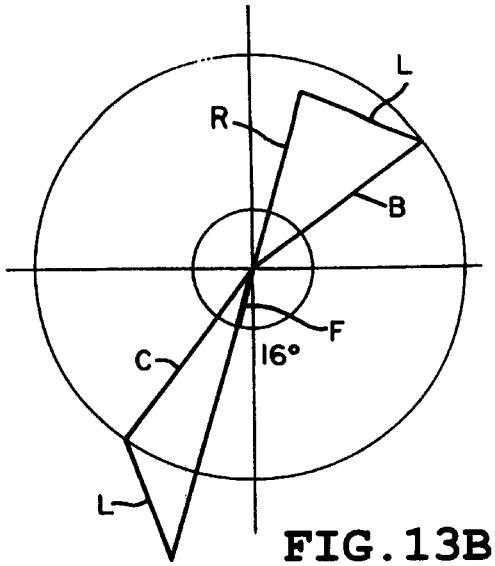
Figure 13C:
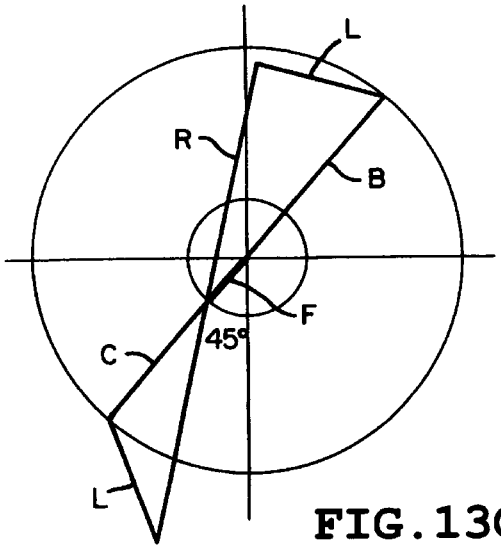
Figure 13D:
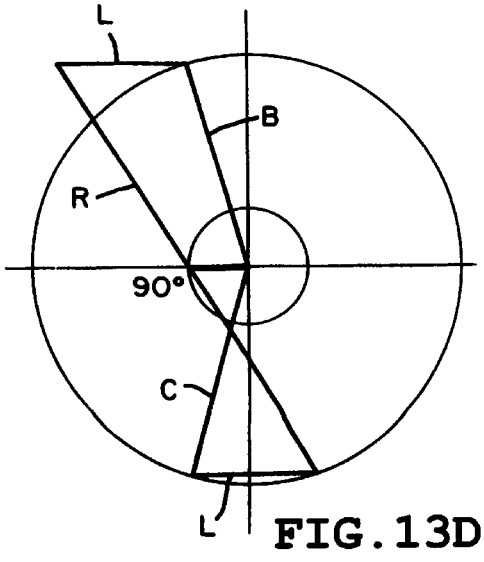
Figure 13E:
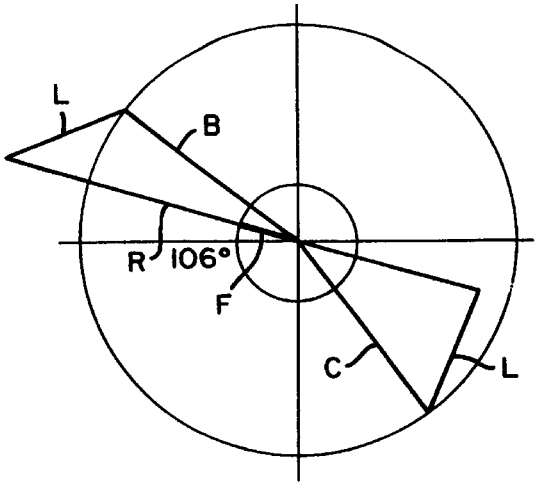
Figure 13F:
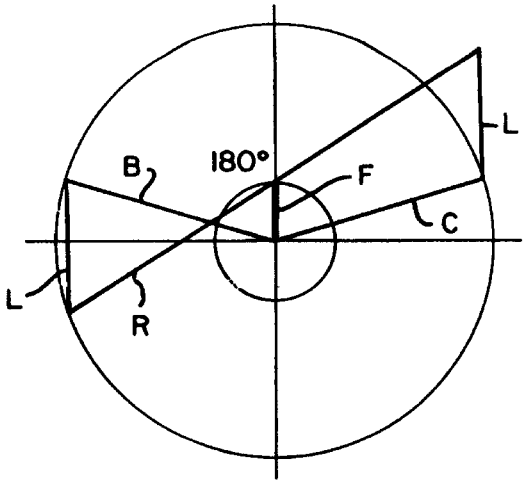
Figure 13G:
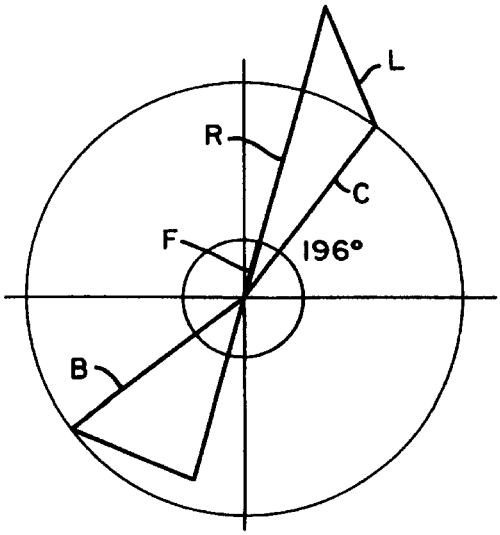
Figure 13H:
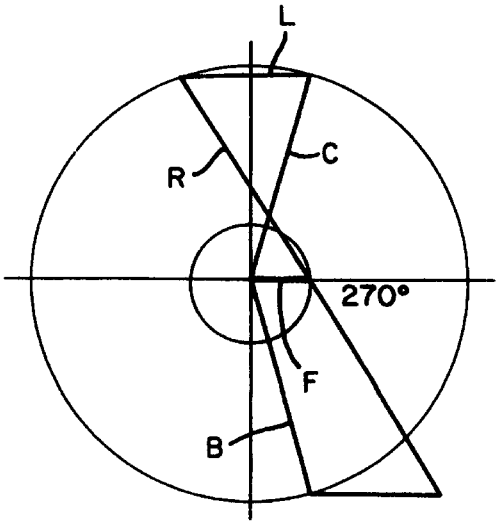
Figure 13I:
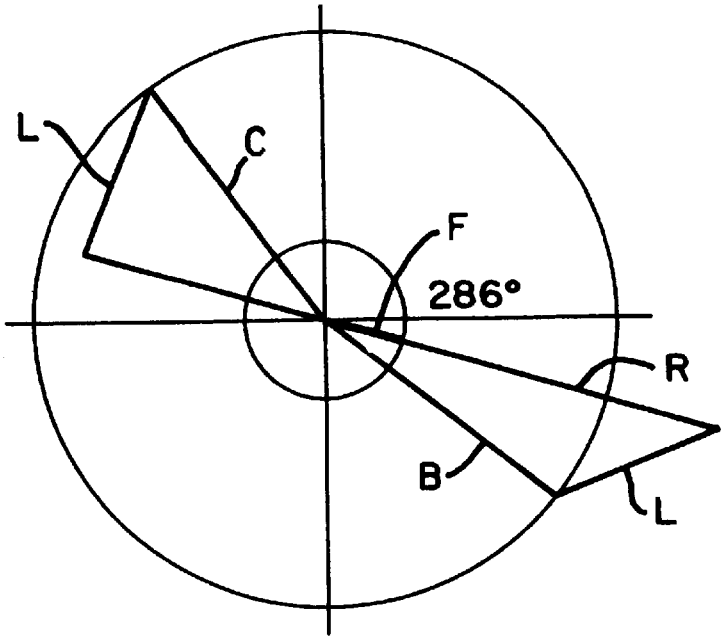
Figure 13J:
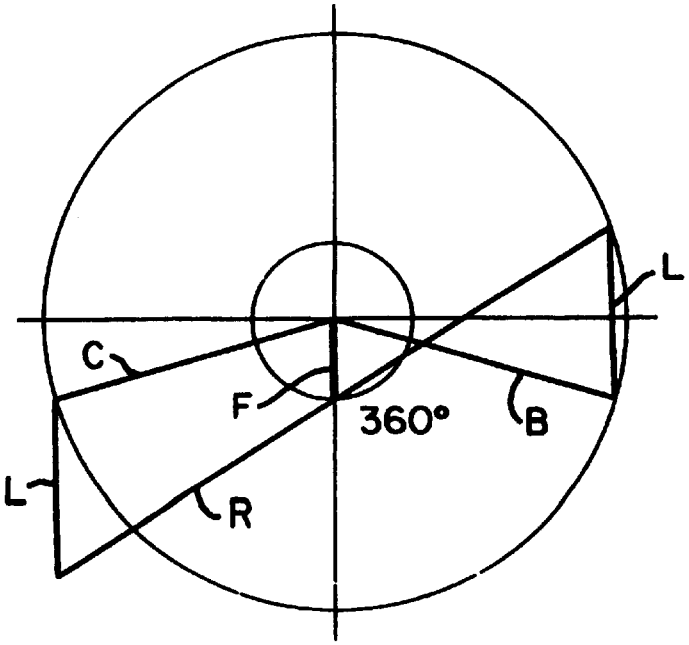
Figure 13K:
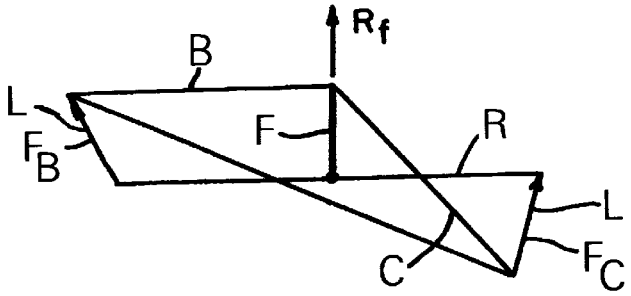
FIG. 13K is a schematic illustration of the mechanism of the invention showing equal forces at links L which results in the absence of torque during combustion.

Another important feature of the mechanism 18 is that during the power stroke, the gears 24, 26, 36 and 48 are generally not loaded due to the geometry of the mechanism 18. During combustion (when pressure and forces are at a maximum), the most vulnerable link of the mechanism 18 is the teeth of the timing gears of the mechanism. Thus, to avoid damage to the gear teeth, the mechanism is designed to direct forces from the rotor assemblies 14 and 16 to the crankshaft structure mostly through the connecting links 68 and 60 to the pins 62, 78 and 79, without torque. Each connecting link is loaded approximately ⅔ of the initial gas force. With reference to FIG. 13K, it can be seen that during combustion, $F_C=F_B$ with the resulting force $R_f=(F_C+F_B)\cos(\gamma/4)$. Since $F_C=F_B$, there is no torque generated at TDC and BDC, thus the resultant force is on the pins at connecting portions 76 and 90, and not on the gear teeth.

Figure 22:
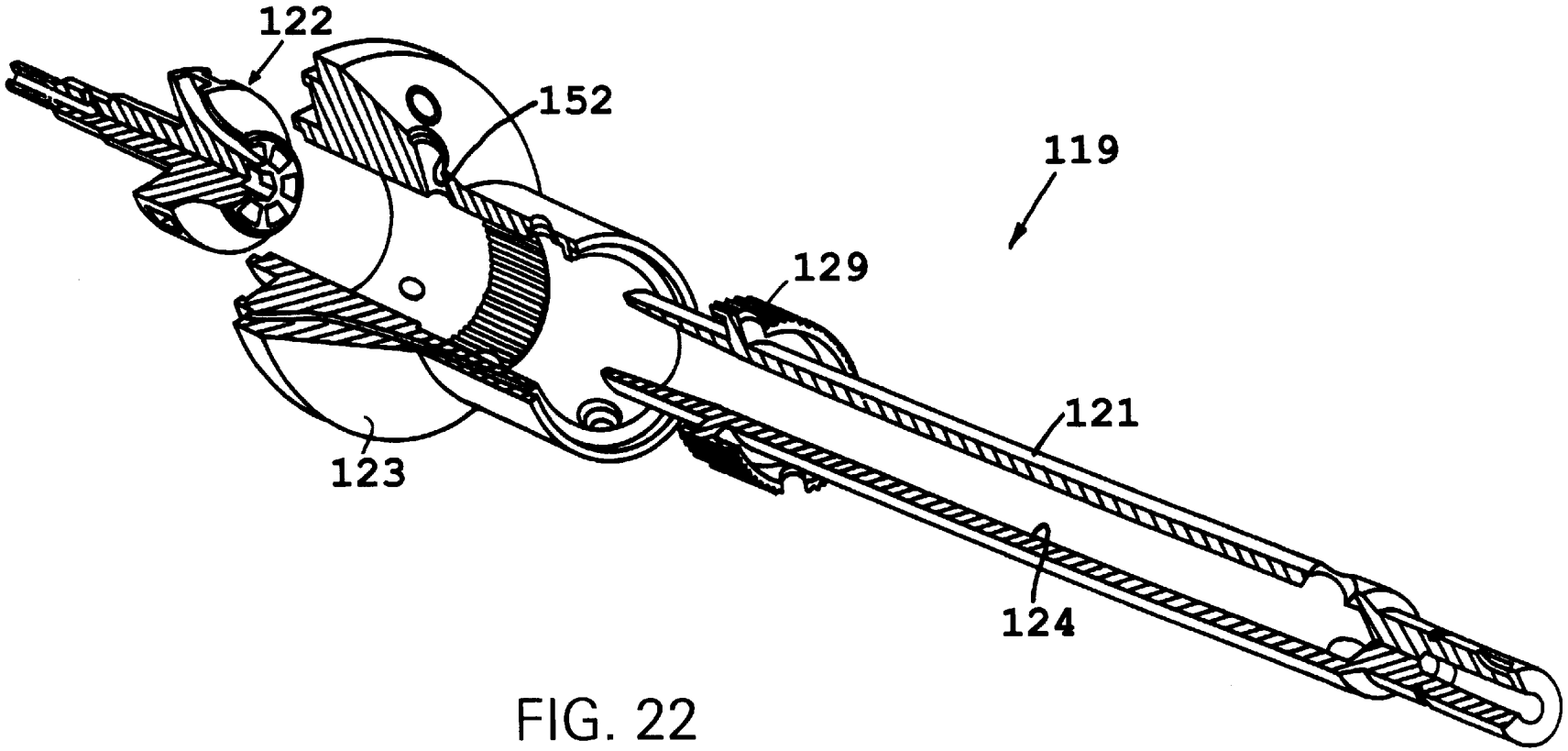
FIG. 22 is an exploded perspective view of the liquid cooling distribution structure of the engine.

With reference to FIGS. 1B and 22, centrally located within the engine is liquid cooling distribution structure, generally indicated at 119, comprising an elongated water feed tube 121 in fluid communication with a radiator (not shown) and an impeller 122 adjacent to the feed tube 121 for drawing water from the radiator through the feed tube. The impeller 122 is in threaded engagement with the crank member 50 to rotate about the longitudinal axis 23. End 127 of the rotating feed tube 121, which is driven via sprocket 129 may include motion transmitting structure 125 coupled thereto to provide a secondary power source as is known in the art.

With reference to FIGS. 1B, 10,14, 16 and 22, the water cooling system of the engine 10 will be appreciated. The impeller 122 draws water through the central portion 124 of tube 121. Water is then directed to passages 126 and 128 in the body 80 and is then directed to the distribution disk 82 to which the pistons 84$A_1$ and 84$A_2$ are coupled. Water from passage 126 flows into channel 130 (FIG. 10) and enters piston 84$A_2$ at inlet 131 while water from passage 128 flows into channel 132 enters piston 84$A_1$ at inlet 133. As shown, the water enters each piston 84$A_1$ and 84$A_2$ at a bottom portion thereof and flows through a passage 134 in a water separator 110 (FIG. 12) defined in the interior of each piston 84$A_1$, 84$A_2$. The water circulates in the upper portion of each piston 84$A_1$, 84$A_2$ and exits each piston at respective outlet ports 138 and 140 (FIG. 10) so as to flow into respective channels 142 and 144 located in an outer portion of disk 82. Water from channels 142 and 144 enters respective passages 146 and 148 (FIG. 14) defined in the body 80.

With reference to FIGS. 1B, 8, and 22, water then passes to passage 150 (FIG. 16) located at the outside of tube 121, and moves through port 152 and into inlet ports 154 in pistons 100$B_1$ and 100$B_2$ and fills the interior volume of each of these pistons. Water exits piston 100$B_1$ and 100$B_2$ through their exit ports 156 and flows to main body 88, which houses pistons 100$B_1$ and 100$B_2$. As best shown in FIG. 8, water contacts the outer surface 158 of the main body 88 and then enters a plurality of channels 160 to cool an outer portion of the body 88. Next, the water in channels 160 communicate with a tube 162 (FIG. 1B) disposed in the interior of each of the pistons 100$B_1$ and 100$B_2$. Tube 162 communicates with passage 164 which in turn communicates with passage 165 and is returned to the radiator via water return port 226 of manifold 220. As seen in FIG. 1B, the liquid cooling distribution structure 119 is sealed by seals 166, which separates water at the impeller from oil at the crankshaft structure 20, a pump seal 168 and a seal 170.

Thus, it can be appreciated that the two rotor assemblies 14 and 16 and their corresponding pistons 84$A_1$, 84$A_2$, and 100$B_1$ and 100$B_2$, are cooled effectively by the serial water distribution system of the invention wherein water is first sent through and thereafter is sent through pistons 100B. It can be appreciated that a parallel cooling circuit could be provided wherein water us sent to pistons 84A and pistons 100B in generally simultaneously.

With reference to FIG. 1B, it can be seen that oil is used to lubricated and cool rotating engine components. A conventional oil pump 172 draws oil from reservoir 174 and sends oil through passage 176 to lubricate bearing 98, through passages 178, 180, 182 and 184 to lubricate the crankshaft structure 20 and bearing structure 22. Next oil flows through central passage 186 to passage 188 to lubricate bearings 190 of the satellite gears 26 and 36. Next, oil is sent to bearing 42 and flows through passages 192 in crank member 50 to lubricate the link connections. Oil is pumped through passages 196 and 198 to lubricate bearings 96 and 56. Oil continues down the central passage 186 to lubricate bearing 70 via passage 200 and bearings 92 and 94 via passages 201, 202, and 203.

Figure 16A:
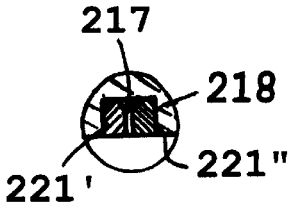
FIG. 16*a* is a sectional view taken along the line 16*a*—16*a* of FIG. 16.

Oil is also used to a seal certain piston contact surfaces via chevrons or oil distribution structure defined in the pistons 84A and 100B. The chevrons are configured as show in FIG. 11A, having an expander 217 separating two members 221' and 221", thereby defining an oil flow space 219 for delivering oil along contact surfaces. With reference to FIG. 16, after lubricating ring 215 at disk 82, to seal pistons 100B contact surfaces oil moves through passages 204 in the body 123 coupled to the second rotor assembly 16. Passages 204 communicate with chevrons 216 in each of pistons 100$B_1$ and 100$B_2$ to provide an oil seal between pistons 100$B_1$ and 100$B_2$ and disk 82. Oil exits pistons 100B via port 210. In addition, oil is sent through passage 205 in body 123 which communicates with chevron 218 in piston 100$B_2$ and, via passage 223, with chevron 218' in piston 100$B_1$ to provide an oil seal between the pistons 100$B_1$ and 100$B_2$ and the manifold 220. Oil is also directed to seal ring 214 via port 213. Oil exits through port 221 and returns to the reservoir 174. Chevrons 216 are generally identically configured as shown in FIG. 16*a*, including an expander 217 separated by two members 221' and 221".

Sealing of contact surfaces of pistons 84$A_1$, 84$A_2$ will be appreciated with reference to FIG. 1B. Oil is sent through ports 203 in the disk 82. Ports 203 communicate with chevrons 207 and 206 in pistons 84A to provide an oil seal between pistons 84A and the body 88. Oil is also directed through passages 211 in disk 82. Passages 211 communicate with chevrons 209 in pistons 84A to provide an oil seal between pistons 84A, body 123 and manifold 220. As pistons 84A rotate, oil collects in recess 213 (FIG. 6) in top surface 109 of each the pistons 84$A_1$ and 84$A_2$ and then is returned to the oil reservoir 174 via diametrically opposed drainage holes 215 in body 88. Body 88 is thus not sealed.

The chevrons 216 and 218 of pistons 100$B_1$ and 100$B_2$ are best shown in FIG. 8. Since pistons 84$A_1$ and 84$A_2$ slide with respect to interior surfaces of main body 88, pistons 84$A_1$ and 84$A_2$ have the additional chevrons 206 defined in front surface 103 and the top surfaces 109' thereof (FIG. 6), which are employed to provide a seal with the interior surfaces of the main body 88.

Figure 17:
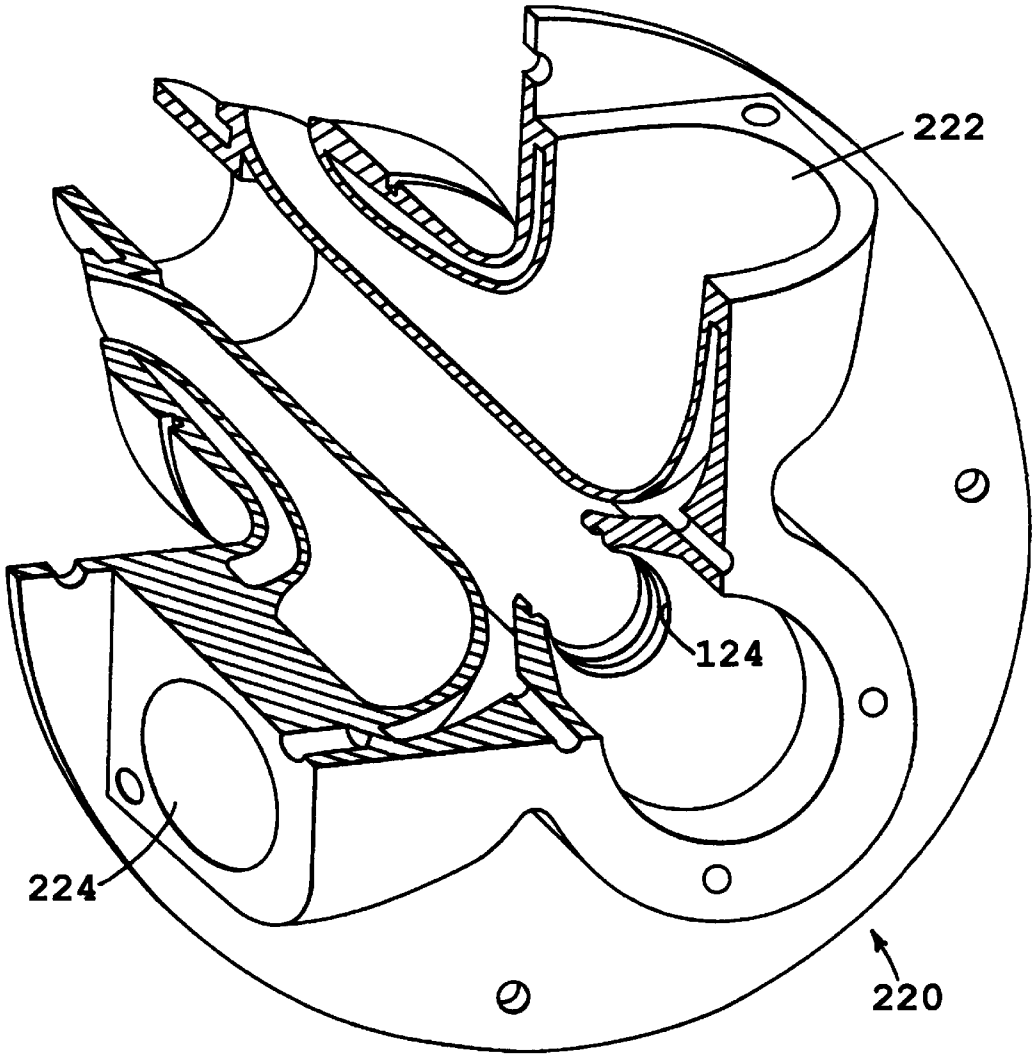
FIG. 17 is a perspective view of the manifold of the engine of the invention showing the intake and exhaust ports.
Figure 18:
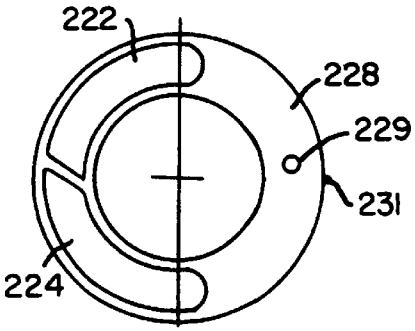
FIG. 18 is a perspective view of the manifold of the engine of the invention showing injector location.
Figure 19:
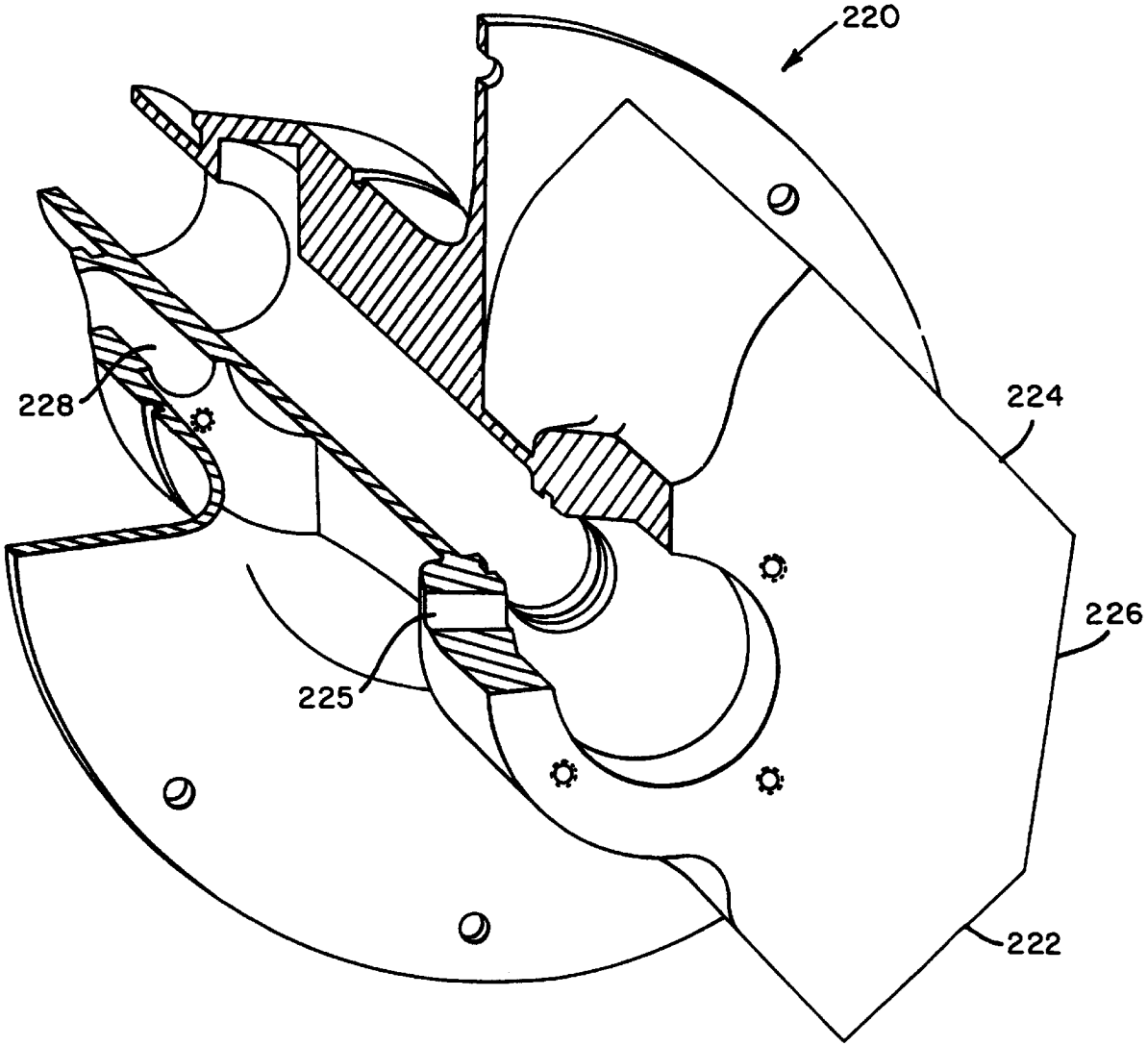
FIG. 19 is a sectional view the manifold of the invention showing the intake and exhaust ports and the location of an injector or a spark plug.

As shown in FIG. 1B, the liquid cooling distribution structure 119 is disposed concentrically with an intake an exhaust manifold, generally indicated at 220 that is fixed with respect to the housing 12. In the broadest aspects of the invention, the liquid cooling distribution structure 119 can be considered to be part of the manifold 220. A shown in FIGS. 17–19, the intake an exhaust manifold 220 includes an intake port 222 and an exhaust port 224 which communicate with the working chambers upon rotation of the pistons 84A and 100B. In addition, a water inlet port 225 is provided for introducing water to the liquid cooling distribution structure. Also, a water return port 226 is provided that communicates with the booster passage 150 to return water to the radiator. With reference to FIGS. 18 and 19, it can be seen that a portion 228 of the manifold 220 opposite the intake and exhaust may house spark plugs and/or fuel injectors 229 disposed around tube 121 of the distribution structure 119. Point 231 in FIG. 18 represents top dead center (TDC). Thus, with this arrangement, it is relatively easy to replace the spark plugs or injectors 229 by simply removing the liquid cooling distribution structure 119 to gain access to the plugs or injectors. Two or more fuel injectors may be provided to inject fuel on one side of the piston and then on the other side thereof. This gives one injector time to cool down while the other injector is operating.

The centrally located manifold 220 provides the intake and exhaust ports at locations where the pistons 84A and 100B rotate at relatively low speed, which advantageously reduces mechanical losses. The manifold together with the liquid distribution structure 119 provides effective cooling of the pistons assemblies via water circulating through the pistons which reduces warping of the pistons. Further, the manifold location and design dictates the shape of the pistons 84A and 100B, i.e, octagonal.

In the illustrated embodiment, the manifold has one intake port and one exhaust port to perform the four stroke cycle. It can be appreciated that two intake ports and two exhaust ports may be provided for a two-cycle engine.

In the illustrated embodiment, the engine is designed to operate on diesel fuel. Gasoline or other combustible fuels are also contemplated. In the diesel engine, diesel fuel is injected or sprayed inside a combustion chamber so as to the disposed on a wall thereof and to be in the internal volume thereof, in the known manner. During the compression cycle the fuel is injected by injector 229 before top dead center. If an engine uses spark plugs, the plugs are set to fire a few degrees before top dead center to provide time for combustion.

Referring now to FIG. 20, a portion of the sequential operating positions of the engine pistons 84$A_1$, 84$A_2$, 100$B_1$ and 100$B_2$ are shown schematically and the functions at the four engine working chambers are identified in chart form. The working chambers are defined by the two adjacent pistons between which the working chamber is formed and by the letter A, B, C, and D. Although the pistons of the invention are not identically configured, it is noted that the pistons are shown in FIG. 20 to be of the same wedge shape for ease of illustration. In the illustrated engine operation, air is supplied to the engine through the intake port 222. Since fuel injection is employed, injection of the fuel can occur either during the compression phase or, at the end of the compression phase. Regardless of how air and fuel are introduced and the working chambers, or how they are ignited, FIG. 20 illustrates engine operation advantages provided by the mechanism employed by the engine of the invention. The piston assemblies are shown at five different positions in FIG. 20, which positions are labeled 1 through 5. The drawing shows the expansion portion of the cycle.

At position 1 of FIG. 20, ignition takes place in working chamber A between pistons 100$B_1$ and 84$A_1$ when the working chamber A is at substantially its smallest volume, compression starts in working chamber B, air/fuel mixture starts to be drawn into working chamber C through intake port 222 and the exhaust of spent gases through the exhaust port 224 begins at working chamber D. The power, compression, intake and exhaust phases occur at the respective working chambers A, B, C, D and continue from positions 1 through 5 of the piston assemblies shown FIG. 20.

In the piston assembly travel from positions 1 through 5 of FIG. 20, one phase of the four phase operating cycle is completed within each of the working chambers. The entire phase of the four phase operating cycle for one complete revolution of travel can be derived from the discussion above. A complete engine operating cycle takes place at each working chamber with each complete rotation of the piston assemblies, for a total of four complete engine operating cycles per revolution of the piston assemblies.

Figure 21:
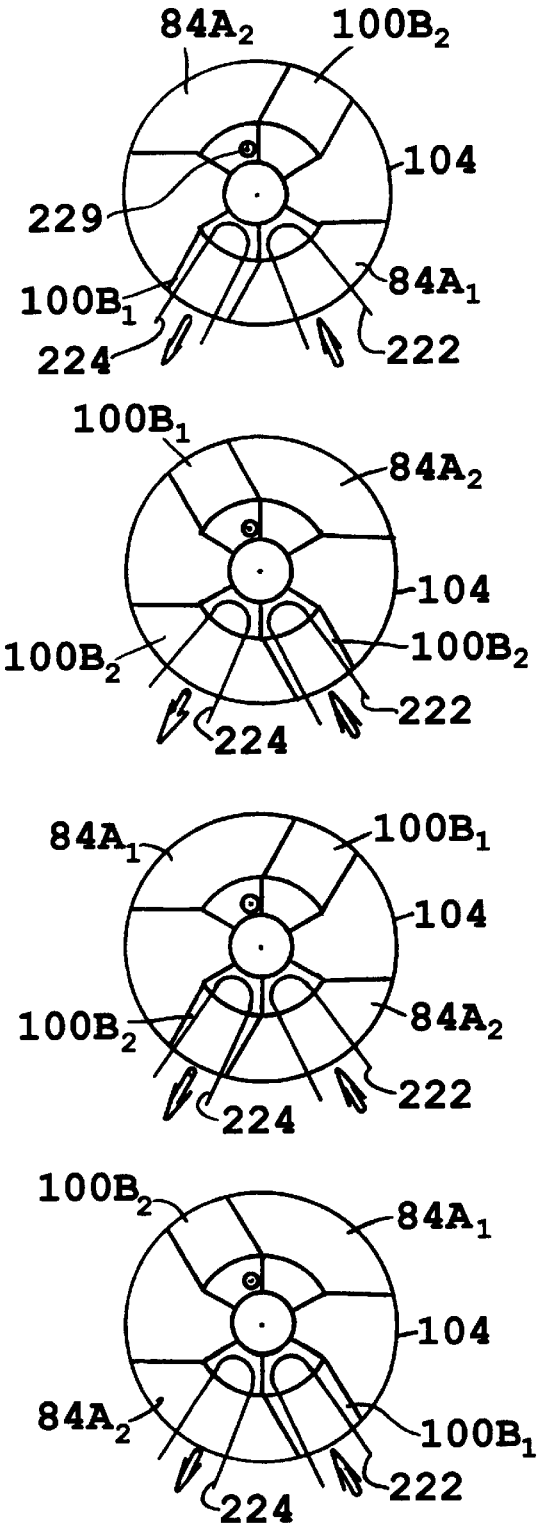
FIG. 21 is a chart illustrating piston locations during an operating sequence.

FIG. 21 shows the relationship between the pistons pairs 84A and pairs 100B at top dead center at various angles of rotation of the crankshaft structure 20.

Figure 28:
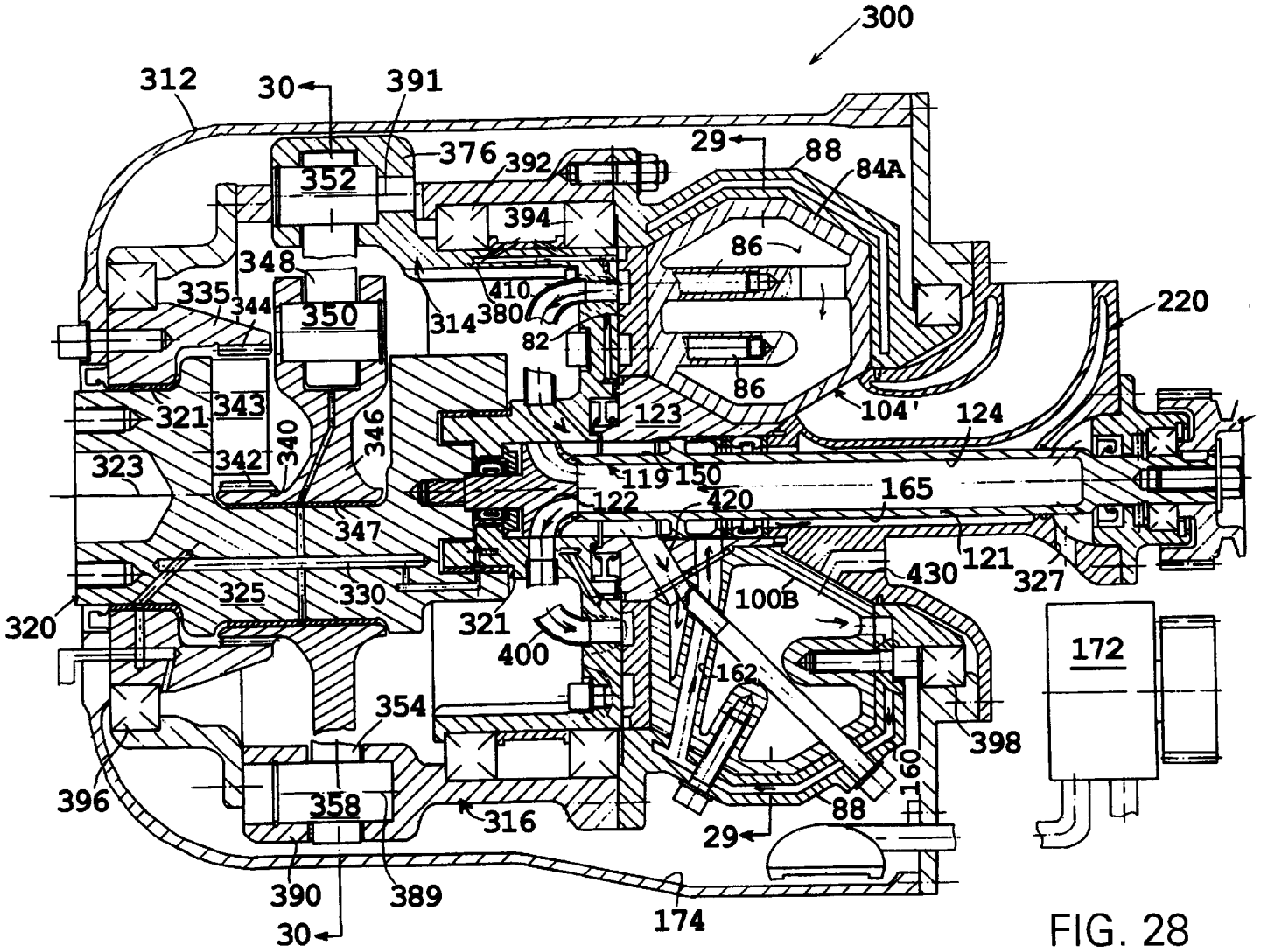
FIG. 28 is a schematic illustration of an the engine provided in accordance with an second embodiment of the invention.

With reference to FIG. 28, an internal combustion rotary engine is shown, generally indicated at 300, which embodies the principles of a second embodiment of the present invention, wherein like parts are given like numerals. It is noted that FIG. 28 is a view similar to that of FIG. 1A, illustrating the interrelation of the elements of the structure. The engine 300 is similar to engine 10, but has a different force transfer mechanism design and a simpler arrangement.

Figure 30:
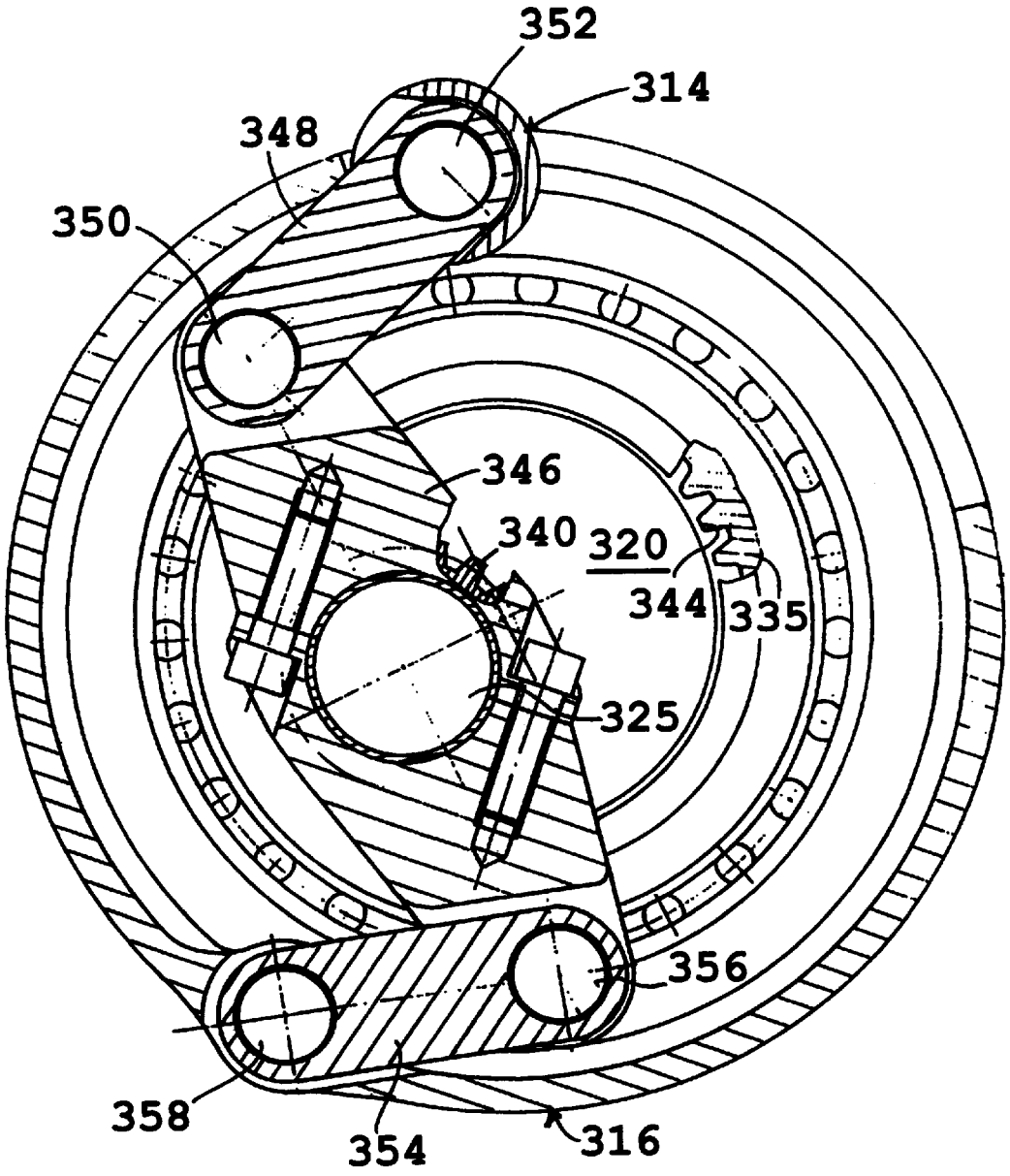
FIG. 30 is a sectional view taken along the line 30—30 in FIG. 28.

The engine includes a housing 312. A first rotor assembly, generally indicated at 314, and a second rotor assembly, generally indicated at 316, are mounted for rotational movement within the housing 312. The rotor assemblies 314 and 316 are best shown in FIG. 30 and are configured similarly to those of the first embodiment. The engine 300 also includes a force transfer mechanism, generally indicated at 318, for controlling the relative movement of the rotor assemblies.

Figure 23:
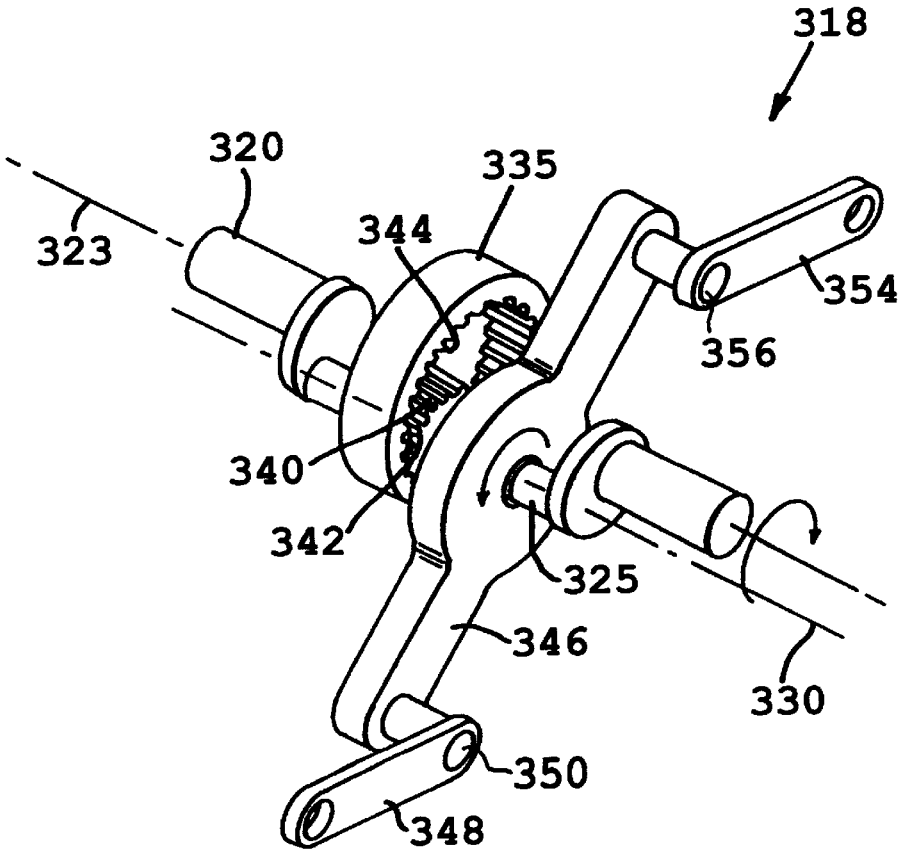
FIG. 23 is a perspective view of a force transfer mechanism provided in accordance with the principles of a second embodiment of the present invention.
Figure 14:
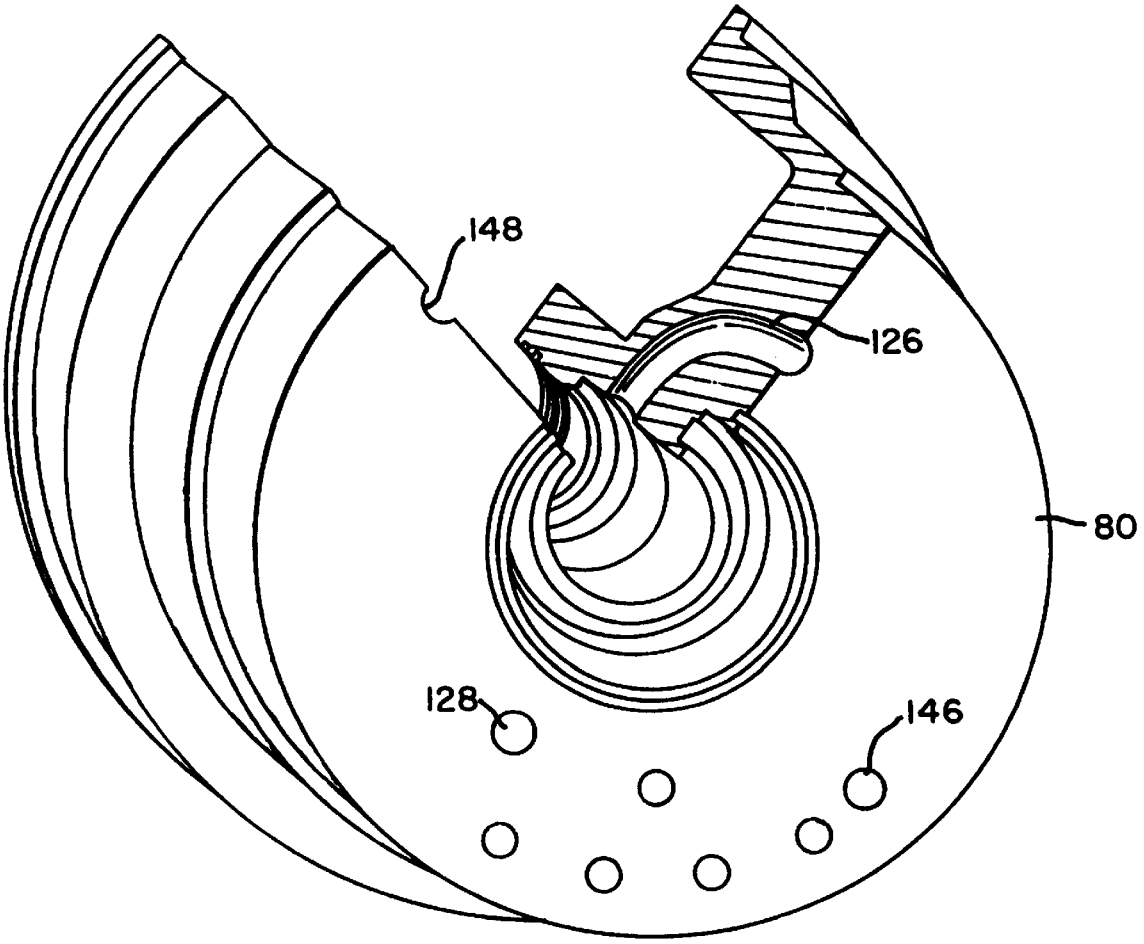
FIG. 14 is a perspective view, partially in section, of a body of the first rotor assembly.

The components of the force transfer mechanism 318 are best shown schematically in FIG. 23 and in section in FIG. 30 and include a crankshaft structure 320 is supported by sliding bearings 321 to rotate with respect to housing 312 about longitudinal axis 323. Crankshaft structure 320 has a shaft 325 having an axis 330 offset from the longitudinal axis 323. A sungear 335 is fixedly mounted to the housing 312 (not shown in FIG. 23) of the engine 300. A planetary gear 340 is mounted within the sungear 335 such that external teeth 342 of planetary gear 340 engage with the internal teeth 344 of the sungear 335. Counterweight 343 is also provided. The relative number of gear teeth is as follows:

(# teeth of sungear 335)/(# teeth of planetary gear 340)=2

A crank member 346 is fixedly coupled to the planetary gear 340 and is mounted for rotation about shaft 325 via sliding bearings 347. One end of a connecting link 348 is coupled via a pin 350 to one arm of the crank member 346. The opposite end of link 348 is coupled to the first rotor assembly 314 via pin 352 (FIGS. 28 and 30). It is noted that the housing 312 is not shown in FIG. 30 for clarity of illustration. One end of connecting link 354 is coupled via a pin 356 to an opposing arm of the crank member 346. The opposite end of link 354 is coupled to the second rotor assembly 316 via pin 358 (FIGS. 28 and 30). Centers of pins 350 and 356 are spaced an equal distance from axis 330. The distance between center of pins 356 and 358 is equal to the distance between pins 350 and 352.

Planetary gear 340 is mounted such that rotation of the crank member 346 occurs in a direction opposite to the direction of rotation of the crankshaft structure 320, as indicated by the arrows in FIG. 23. It can be appreciated that an idler gear (not shown) may be provided between the planetary gear 340 and the sungear 335 to change the direction of rotation of the crank member 346 if desired.

As shown in FIGS. 28, the first rotor assembly 314 is a generally cylindrical rotatable body 380 which defines a connecting portion 376 receiving pin 352. The cylindrical water distribution disk member 82 is bolted to the body 380 on a face thereof. A piston assembly, generally identical to that of the first embodiment, includes a pair of diametrically opposed, identically configured pistons 84$A_1$ and 84$A_2$ coupled to the disk member 82 via bolts 86.

Figure 29:
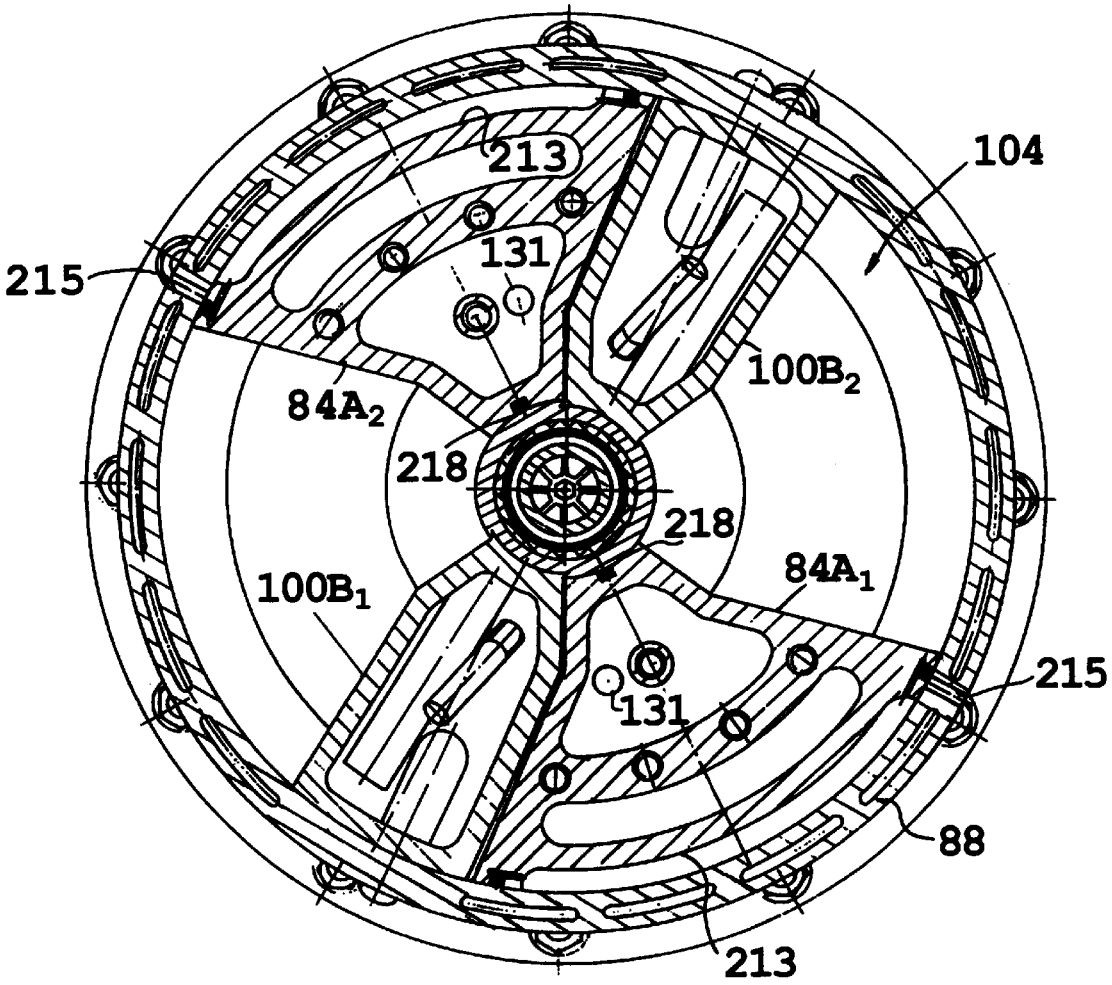
FIG. 29 is a sectional view taken along the line 29—29 in FIG. 28.

The second rotor assembly 316 is oriented concentrically with the first rotor assembly 314 and is mounted for rotation about the axis 323. The second rotor assembly 316 is generally identical to that of the first embodiment and has a main body 88 in the form of a drum which defines a rotating displacement volume 104'. Pistons 100$B_1$ and 100$B_2$ are mounted to an interior surface of the body 88 (FIG. 29) in the manner described above with reference to the first embodiment of the invention to divide the internal volume 104' into two sections. Pistons 84$A_1$ and 84$A_2$ divide each of the two sections into two working chambers for a total of four working chambers. The body 88 defines a connecting portion 390 which receives pin 358. The center 389 of the connecting portion 390 is located a radial distance from the second axis longitudinal axis 323 that is equal to a radial distance from a center 391 of connecting portion 376 to the longitudinal axis 323, as in the first embodiment.

In the illustrated embodiment, the first rotor assembly 314 is disposed within the drum body 88 and is mounted for rotation therein via rolling bearings 392 and 394 (FIG. 28). The second rotor assembly 316 is mounted for rotation with respect to the housing 312 via rolling bearings 396 and 398.

As in the first embodiment, fluid distribution structure 119 is provided. However, the water flow paths to cool the pairs of pistons 84A and 100B are different from that of the embodiment of FIG. 1B. In particular, as shown in FIG. 28, water enters inner tube 124 via inlet port 327 and is sent through tube 400 and into the distribution disk 82 and into inlets 131 (FIG. 29) and circulates through pistons 84A in the manner discussed above with reference to the first embodiment of the invention. Water exits pistons 84A via tube 410 and moves through passage 420 in body 123 and enters the pistons 100B and circulates therein, as shown by the arrows in FIG. 28. Water passes to the outer passage 160 and exits the pistons 100B through passage 162. Passage 162 communicates with passage 165 via passage 150 permitting water to exit the manifold 220 and return to the radiator (not shown).

The engine 300 also includes oil flow passages for lubricating rotating elements, i.e., bearings, and oil flows along the sealing elements in the manner discussed above with reference to the first embodiment of the invention. For example, oil passages 215 in body 88 (FIG. 29) communicate with pistons 84$A_1$, 84$A_2$ such that oil may return to the oil reservoir 174.

Port 430 in the manifold 220 is provided for housing the spark plug or injector for the engine 300.

As is evident from the discussion above, movement of the rotor assemblies 314 and 316 is controlled by the mechanism 318 which can be arranged such that the crankshaft structure 320 rotates with an angular velocity of $\omega_{crankshaft}=(\omega_{rotor\ 314}+\omega_{rotor\ 316})/2$(1/sec) in a direction opposite to that of the crank member 346, where $\omega_{rotor\ 314}$ is the angular velocity of the rotor assembly 314 and $\omega_{rotor\ 316}$ is the angular velocity of the rotor assembly 316. Alternatively, the mechanism 318 can be arranged such that the crankshaft 320 rotates with the angular velocity of $\omega_{crankshaft}=(\omega_{rotor\ 314}+\omega_{rotor\ 316})/4$ (1/sec) in the same direction or rotation as the crank member 346.

It can be appreciated that the mechanism 318 of FIGS. 23 and 28 is arranged in a manner similar to that of FIG. 1A in that reaction forces generated during an operating cycle are equal and in opposite direction at the connections between link 354 and crank member 346 and at the link 348 and the crank member 346, such that torque is not exerted on the crank member at TDC and BDC.

The engine of each embodiment of the invention is fully balanced. Inertia forces occur at the first, second and fourth order harmonics. The inertia forces of the first and second order are balanced simply by counterweights provided in the engine. The inertial forces at the fourth order can be balanced by matching the moments of inertia between the rotor assemblies with that of the crankshaft structure.

Another advantage of the invention is the ease in which the engine displacement can changed. Conventionally, a family of engines having different displacements and number of cylinders are provided. With the engine of the invention, it can be 10 appreciated that reducing the size of the rotor assemblies while using the force transfer mechanism sized for the largest engine, the displacement can be changed. In a gas-fueled engine, the size of the rotor assemblies may be increased without changing the mechanism, since in the gasoline engine, less load is required than in diesel engines. Thus, for automotive engines, it is within the contemplation of the invention to provide a series of engine sizes to provide a corresponding series of engine powers, such as 300 hp, 200 hp and 100 hp by simply selecting the types or sizes of rotor assemblies and the force transfer mechanism.

A further advantage of the invention is the ability to reduce engine speed by changing the arrangement of the force transfer mechanism. It can be appreciated that the engine of the invention can be used to power helicopters which require high torque. Currently helicopters employ a large and heavy gear box to reduce the speed of the turbine which operates at approximately 12,000 rpm to be approximately 150 rpm at the rotor. With the invention, this reduction in power can be accomplished by changing the gear arrangement of the mechanism, with smaller, more simple gearing.

The sealing system of the invention makes it possible to reduce the total sealing surface of the seals to approximately 12–15% from conventional engines, and by eliminating oil scrapers, the total frictional work losses can be reduced to approximately 7–8% of that of conventional engines having oil scrapers.

Since the engine of the invention operates twice faster than a conventional engine, and after combustion the speed of the piston increases to exhaust gasses quickly. Thus, by reducing the time of the cycle, heat transfer is reduced which permits more thermal energy to be used for power and not to be rejected to the cooling system.

Further, the mechanical losses of the engine of the invention are less than that of a conventional engine since, in the engine of the invention, there is no valve train and there are no friction losses due to the use of piston rings. Thus, with the engine of the invention, less work is spent on friction with more work being used for power. The smaller the friction loss, the longer service life of the engine and the less wear on the principle mating parts.

The centrally located manifold provides the intake and exhaust ports at locations where the pistons rotate at relatively low speed, which advantageously reduces mechanical losses. The manifold together with the liquid distribution structure provides effective cooling of the pistons assemblies via water circulating through the pistons which reduces warping of the pistons.

While the invention has been described in connection with what is presently considered to be the most practical and preferred embodiments, it is understood that the invention is not limited to the disclosed embodiments, but, on the contrary, is intended to cover various modifications and equivalent arrangements included within the spirit and scope of the appended claims.

What is claimed is:

1. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water cooling means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages.

2. The internal combustion engine according to claim 1, wherein said mechanism is constructed and arranged such that reaction forces generated during an operating cycle are substantially taken-up by said linkages.

3. The internal combustion engine according to claim 2, wherein said linkages include a crank member operatively associated with a crankshaft of said crankshaft structure for rotational movement with respect to said crankshaft, and first and second links, said first link connecting said outer rotor assembly to said crank member and said second link connecting said inner rotor assembly to said crank member, said mechanism being constructed and arranged such that reaction forces generated during an operating cycle are equal and in opposing directions at connections between said first link and said crank member and at said second link and said crank member, such that torque is not exerted on said crank member at top dead center or at bottom dead center locations.

4. The internal combustion rotary engine according to claim 1, wherein said outer rotor assembly comprises a body in the form of a generally cylindrical drum, said pistons of said outer rotor assembly being fixed within an internal portion of said body and wherein said inner rotor assembly comprises a body with said pistons of said inner rotor assembly being fixed to said body thereof, said body of said inner rotor assembly being sized to be received within the internal portion of said body of said outer rotor assembly such that each piston of said outer rotor assembly cooperates with a piston of said inner rotor assembly to define a working chamber during rotation of the rotor assemblies.

5. The internal combustion rotary engine according to claim 1, further comprising a manifold fixed to said housing and having an axis aligned with said housing axis, said manifold having at least one intake port and at least one exhaust port, each of said ports being in periodic communication with said working chambers upon rotation of said rotor assemblies.

6. The internal combustion rotary engine according to claim 1, wherein each of said pistons of said inner and outer rotor assemblies includes oil distribution structure in certain walls thereof, said oil distribution structure being in communication with a source of oil so as that oil may flow along said distribution structure to seal certain piston surfaces.

7. The internal combustion rotary engine according to claim 1, wherein said mechanism comprises:

crankshaft structure having a longitudinal axis and mounted for rotation with respect to said housing about said longitudinal axis, a stationary gear fixed with respect to said housing and axially aligned with said longitudinal axis, a first satellite gear having and axis and being coupled to said crankshaft structure for rotational movement about said axis of the first satellite gear, said first satellite gear axis being spaced from said longitudinal axis, said first satellite gear being in operatively associated with said stationary gear so as to move about said longitudinal axis, a second satellite gear coaxial with said first satellite gear so as to rotate in the same direction as said first satellite gear and to move with said first satellite gear about said longitudinal axis, a main crank assembly having an axis and being operatively associated with said crankshaft structure for rotational movement with respect thereto and being mounted for rotational movement about the axis of the main crank assembly, said main crank assembly axis being spaced from said longitudinal axis, said main crank assembly including a main gear operatively associated with said second satellite gear, said main crank assembly including a crank member operatively coupled with said main gear and having diametrically opposed connection locations, each connection location being oriented substantially an equal radial distance from said axis of said main crank assembly, first and second links each having one end rotatably coupled to said crank member at an associated connection location, said links having substantially the same length, said outer rotor assembly being mounted for rotation with respect to a crank arm portion of said crankshaft structure about said longitudinal axis of said crankshaft structure, said crank arm portion being operatively associated with said main crank assembly so as to rotate about said main crank assembly axis, and said crank arm portion having a second rotational axis spaced from said main crank assembly axis and aligned with said longitudinal axis of said crankshaft structure, said outer rotor assembly having a connecting portion located a predetermined radial distance from said second rotational axis, a second end of said first link being rotatably coupled to said connecting portion, said inner rotor being mounted for rotation about said longitudinal axis, said inner rotor assembly having a connecting portion located substantially said predetermined radial distance from said second axis, a second end of said second link being rotatably coupled to said connecting portion of said inner rotor assembly, and bearing structure for rotatably supporting said inner and outer rotor assemblies, whereby, as said crankshaft structure rotates at a constant speed, said main crank assembly rotates in one direction about said main crank assembly axis while moving about said longitudinal axis in a direction opposite said one direction, and said crank arm portion rotates about said second axis common with said longitudinal axis in a direction opposite said one direction, thereby causing respective connecting locations of said crank member to be disposed at periodically variable radial distances with respect to said longitudinal axis, which in turn ensures that said inner and outer rotor assemblies rotate in the same direction relative to each other at recurrently variable speeds.

8. The internal combustion engine according to claim 7, wherein said links are coupled to said crank member and to said connecting portions of said rotor assemblies by pin connections.

9. The internal combustion engine according to claim 8, wherein said mechanism is constructed and arranged such that reaction forces generated during an operating cycle are equal and in opposite directions at said pin connections between said first link and said main crank assembly and at said second link and said main crank assembly, such that torque is not exerted on said main crank assembly at top dead center or bottom dead center locations.

10. The internal combustion engine according to claim 1, wherein said mechanism comprises:

crankshaft structure having a longitudinal axis and mounted for rotation with respect to said housing about said longitudinal axis, said crankshaft structure including a shaft having a shaft axis offset from said longitudinal axis, a sungear fixed with respect to said housing and axially aligned with said longitudinal axis, a planetary gear in meshing relation with said sungear, a crank member having an axis of rotation and coupled to said planetary gear for movement therewith, said crank member having diametrically opposed connection locations, each connection location being oriented substantially an equal radial distance from said axis of rotation of said crank member, first and second links each having one end rotatably coupled to said crank member at an associated connection location, said links having substantially the same length, said outer rotor assembly being mounted for rotation about said longitudinal axis of said crankshaft structure, said outer rotor assembly having a connecting portion located a predetermined radial distance from said longitudinal axis, a second end of said first link being rotatably coupled to said connecting portion, said inner rotor being mounted for rotation about said longitudinal axis, said inner rotor assembly having a connecting portion located substantially said predetermined radial distance from said longitudinal axis, a second end of said second link being rotatably coupled to said connecting portion of said inner rotor assembly, whereby, as said crankshaft structure rotates in one direction at a constant speed, said crank member moves with said planetary gear about said longitudinal axis in a direction opposite said one direction, thereby causing respective connecting locations of said main crank assembly to be disposed at periodically variable radial distances with respect to said longitudinal axis, which in turn ensures that said inner and outer rotor assemblies rotate in the same direction relative to each other at recurrently variable speeds.

11. In an internal combustion rotary engine including a body, first and second piston assemblies each of which assemblies includes at least one pair of diametrically opposed pistons within an internal volume and rotatable about the body axis without contact with an inner surface of said body, said pistons dividing the internal volume into a plurality of pairs of diametrically opposed sub-chambers, a mechanism for interconnecting said first and second piston assemblies for rotation of said first and second piston assemblies in the same direction at recurrently variable speeds, whereby at least one pair of diametrically opposite sub-chambers decrease in volume while at least one other pair of diametrically opposed sub-chambers increase in volume, and for each complete revolution of said pairs of diametrically opposed pistons, a plurality of operating cycles being completed including successive power, exhaust, intake and compression phases, the improvement comprises:

liquid cooling distribution structure mounted concentrically with said body axis for rotational movement about said body axis, said liquid cooling distribution structure being in communication with said piston assemblies so as to cool said piston assemblies via circulating liquid originating from said liquid cooling distribution structure.

12. The internal combustion engine according to claim 11, wherein said impeller is operatively associated with an elongated tube, said impeller being constructed and arranged to draw liquid through said tube from a source of liquid and to said piston assemblies.

13. The internal combustion engine according to claim 12, wherein each of said pistons includes a plurality of walls joined to define an interior volume, said interior volume being in liquid communication with said source of liquid so that liquid circulates through said interior volume.

14. In an internal combustion rotary engine including a body defining an internal volume, first and second piston assemblies each of which assemblies includes at least one pair of diametrically opposed pistons within the internal volume and rotatable about the body axis without contact with an inner surface of said body, said pistons including sidewalls cooperating to divide the internal volume into a plurality of pairs of diametrically opposed sub-chambers, a mechanism for interconnecting said first and second piston assemblies for rotation of said first and second piston assemblies in the same direction at recurrently variable speeds, whereby at least one pair of diametrically opposite sub-chambers decrease in volume while at least one other pair of diametrically opposed sub-chambers increase in volume, and for each complete revolution of said pairs of diametrically opposed pistons, a plurality of operating cycles being completed including successive power, exhaust, intake and compression phases, the improvement comprises:

said pistons having a plurality of sidewalls joined so as to define an interior volume, said sidewalls of each of said pistons that cooperate to define said sub-chambers having eight edges.

15. The internal combustion rotary engine according to claim 14, further comprising an impeller mounted for rotation about said central axis, said impeller being constructed and arranged to draw liquid into said engine to communicate with said interior volumes of said pistons of said piston assemblies.

16. The internal combustion rotary engine according to claim 14, wherein each of said pistons includes oil distribution structure in certain walls thereof for receiving oil and permitting the oil to flow along said distribution structure to seal piston contact surfaces.

17. The force transfer mechanism according to claim 16, wherein said gear structure is constructed and arranged to permit said crankshaft and said crank member to rotate in opposite directions.

18. A force transfer mechanism for a rotary engine, the rotary engine including first and second rotor assemblies having first and second sets of pistons, respectively, said pistons being oriented to rotate at recurrently variable speeds in a displacement chamber, said force transfer mechanism comprising:

a crankshaft having a longitudinal axis and a shaft member having a shaft axis offset from said longitudinal axis, a crank member mounted with respect to said shaft for rotation about said shaft axis and mounted to orbit said longitudinal axis, said crankshaft and said crank member being rotatable in opposite directions with identical speeds, first and second connections respectively associated with said first and second rotor assemblies to connect said first and second rotor assemblies to said crank member such that said rotor assemblies may rotate about said longitudinal axis, and gear structure coupling said crankshaft with said crank member for controlling movement of said rotor assemblies.

19. The force transfer mechanism according to claim 18, wherein said first and second connections include first and second links, said first link being constructed and arranged to be coupled between said first rotor assembly and said crank member via pin connections and said second link being constructed and arranged to be coupled between said second rotor assembly and said crank member via pin connections.

20. The force transfer mechanism according to claim 19, wherein said mechanism is constructed and arranged such that reaction forces generated during an operating cycle of the engine are equal and in opposing directions at said pin connections between said first link and said crank member and at said second link and said crank member, such that torque is not exerted on said crank member at top dead center or bottom dead center.

21. The force transfer mechanism according to claim 20, wherein said gear structure includes a fixed sungear and a planetary gear in gear teeth meshing relation with said sungear, said planetary gear being operatively coupled with said crank member.

22. The force transfer mechanism according to claim 20, wherein said gear structure includes a first and second pairs of intermeshing gears.

23. An internal combustion rotary engine comprising:

a housing, a rotor including an outer rotor assembly mounted for rotation within the housing about an axis of the housing, said outer rotor assembly having an interior surface defining an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer for assemblies dividing the internal volume into a plurality of pairs of diametrically opposed sub-chambers, said rotor including said rotor assemblies being rotatable without contacting an inner surface of said housing, being provided with water cooling means, and being provided with lubricating means and a mechanism including crankshaft and gear structure and linkages for interconnecting said inner and outer rotor assemblies for rotation of said piston assemblies in the same direction at recurrently variable speeds, whereby at least one pair of diametrically opposed sub-chambers decrease in volume while at least one other pair of diametrically opposed sub-chambers increase in volume, and for each complete revolution of said pairs of diametrically opposed pistons, a plurality of operating cycles being completed including successive power, exhaust, intake and compression phases, said outer rotor assembly having a pair of diametrically opposed oil drainage hole therein and each of said pistons of said inner rotor assembly having a recess in a surface thereof that is generally adjacent to said interior surface of said outer rotor assembly, each of said recess communicating with said oil drainage holes upon rotation of said inner and outer rotor assemblies.

24. An internal combustion rotary engine comprising:

a housing, a rotor including an outer rotor assembly mounted for rotation within the housing about an axis of the housing, said rotor assembly having an internal volume, said outer rotor assembly including a piston assembly comprising at least one pair of diametrically opposed pistons within the internal volume mounted to rotate with the outer assembly, an inner rotor assembly disposed within internal volume of said outer rotor assembly and mounted so as to rotate with respect to said outer rotor assembly about said housing axis, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers said rotor including said rotor assemblies being rotatable without contacting an inner surface of said housing, being provided with water cooling means, and being provided with lubricating means, a mechanism interconnecting said inner and outer rotor assemblies for rotation of said inner and outer piston assemblies about said housing axis in the same direction at recurrently variable speeds, whereby a least one pair of diametrically opposite sub-chambers decrease in volume, and for each complete revolution of said pairs of diametrically opposed pistons, a plurality of operating cycles being completed including successive power, exhaust, intake and compression phases, and manifold structure having a portion fixed to said housing and having an axis aligned with said housing axis, said manifold having at least one intake port and at least one exhaust port each located generally adjacent to said housing axis, each of said ports being in periodic communication with said sub-chambers upon rotation of said rotor assemblies.

25. The internal combustion rotary engine according to claim 24, further including an impeller mounted for rotation about said manifold axis and in communication with a source of liquid to direct liquid to said engine.

26. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water coupling means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume while at least one other pair of diametrically opposed sub-chambers increase in volume, and for each complete revolution while at least one other pair of diametrically opposed sub-chambers increase in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages, each of said piston s of said inner and outer rotor assemblies including oil distribution channels in certain sidewalls thereof, said oil distribution channels being in communication with a source of oil so as that oil may flow along said channels to seal certain surfaces.

27. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume while at least one other pair of diametrically opposed sub-chambers increase in volume, and for each complete revolution while at least one other pair of diametrically opposed sub-chambers increase in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages, said mechanism comprising crankshaft structure having a longitudinal axis and mounted for rotation with respect to said housing about said longitudinal axis, a stationary gear fixed with respect to said housing and axially aligned with said longitudinal axis, a first satellite gear having an axis and being coupled to said crankshaft structure for rotational movement about said axis of said first satellite gear, said first satellite gear axis being spaced from said longitudinal axis, said first satellite gear being in operatively associated with said stationary gear so as to move about said longitudinal axis, a second satellite gear coaxial with said first satellite gear so as to rotate in the same direction as said first satellite gear and to move with said first satellite gear about said longitudinal axis, a main crank assembly having an axis and being operatively associated with said crankshaft structure for rotational movement with respect thereto and being mounted for rotational movement about the axis of the main crank assembly, said main crank assembly axis being spaced from said longitudinal axis, said main crank assembly including a main gear operatively associated with said second satellite gear, said main conk assembly including a crank member operatively coupled with said main gear and having diametrically opposed connection locations, each connection location being oriented substantially an equal radial distance from said axis of said main crank assembly, first and second links each having one end rotatably coupled to said crank member at an associated connection location, said links having substantially the same length, said outer rotor assembly being mounted for rotation with respect to a crank arm portion of said crankshaft structure about said longitudinal axis of said crankshaft structure, said crank arm portion being operatively associated with said main crank assembly so as to rotatable about said main crank assembly axis, and said crank arm portion having a second rotational axis spaced from said main crank assembly axis and aligned with said longitudinal axis of said crankshaft structure, said outer rotor assembly having a connecting portion located a predetermined radial distance from said second rotational axis, a second end of said first link being rotatably coupled to said connecting portion, said inner rotor being mounted for rotation about said longitudinal axis, said inner rotor assembly having a connecting portion located substantially said predetermined radial distance from said second axis, a second end of said second link being rotatably coupled to said connecting portion of said inner rotor assembly, and bearing structure for rotatably supporting said inner and outer rotor assemblies, whereby, as said crankshaft structure rotates at a constant speed, said main crank assembly rotates in one direction about said main crank assembly axis while moving about said longitudinal axis in a direction opposite said one direction, and said crank arm portion rotates about said second axis common with said longitudinal axis in a direction opposite said one direction, thereby causing respective connecting locations of said crank member to be disposed at periodically variable radial distances with respect to aid longitudinal axis, which in turn ensures that said inner and outer rotor assemblies rotate in the same direction relative to each other at recurrently variable speeds.

28. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume while at least one other pair of diametrically opposed sub-chambers increase in volume, and for each complete revolution while at least one other pair of diametrically opposed sub-chambers increase in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages, said mechanism comprising crankshaft structures having a longitudinal axis and mounted for rotation with respect to said housing about said longitudinal axis, said crankshaft structure including a shaft having a shaft axis offset from said longitudinal axis, a sungear fixed with respect to said housing and axially aligned with said longitudinal axis, a planetary gear in meshing relation with said sungear, a crankshaft member having an axis of rotation and coupled to said planetary gear for movement therewith, said crank member having diametrically opposed connection locations, each connection location being oriented substantially an equal radial distance from said axis of rotation of said crank member, first and second links each having one end rotatably coupled to said crank member at an associated connection location, said links having substantially the same length, said outer rotor assembly being mounted for rotation about said longitudinal axis of said crankshaft structure, said outer rotor assembly having a connection portion located a predetermined radial distance from said longitudinal axis, a second end of said first link being rotatably coupled to said connecting portion, said inner rotor being mounted for rotation about said longitudinal axis, said inner rotor assembly having a connecting portion located substantially said predetermined radial distance from said longitudinal axis, a second end of said second link being rotatably coupled to said connecting portion of said inner rotor assembly, whereby, as said crankshaft structure rotates in one direction at a constant speed, said crank member moves with said planetary gear about said longitudinal axis in a direction opposite said one direction, thereby causing respective connecting locations of said main crank assembly to be disposed at periodically variable radial distances with respect to said longitudinal axis, which in turn ensures that said inner and outer rotor assemblies rotate in the same direction relative to each other at currently variable speeds.

29. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume while at least one other pair of diametrically opposed sub-chambers increase in volume, and for each complete revolution while at least one other pair of diametrically opposed sub-chambers increase in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages, a housing, crankshaft structure having a longitudinal axis and mounted for rotation with respect to said housing about said longitudinal axis, a stationary gear fixed with respect to said housing and axially aligned with said longitudinal axis, a first satellite gear having an axis and being coupled to said crankshaft structure for rotational movement about said axis of the first satellite gear, said first satellite gear axis being spaced from said longitudinal axis, said first satellite gear operatively associated with said stationary gear so as to move about said longitudinal axis, a second satellite gear coaxial with said first satellite gear so as to rotate in the same direction as said first satellite gear and to move with said first satellite gear about said longitudinal axis, a main crank assembly having an axis and being operatively associated with said crankshaft structure for rotational movement with respect thereto and being mounted for rotational movement about the axis of the main crank assembly, said main crank assembly including a main gear operatively associated with said second satellite gear, said main crank assembly including a crank member operatively coupled with said main gear and having diametrically opposed connection locations, each connection location being oriented substantially an equal radial distance from said axis of said main crank assembly, first and second links each having one end rotatably coupled to said crank member at an associated connection location, said links having substantially the same length, a first rotor assembly mounted for rotation with respect to a crank arm portion of said crankshaft structure about said longitudinal axis of said crankshaft structure, said crank arm portion being operatively associated with said main crank assembly so as to rotate about said main crank assembly axis and said crank arm portion having a second rotational axis spaced from said main crank assembly axis and aligned with said longitudinal axis of said crankshaft structure, said first rotor assembly having a connecting portion located a predetermined radial distance from said second rotational axis, a second end of said first link being rotatably coupled to said connecting portion, a second rotor assembly oriented concentrically with said first rotor assembly and mounted for rotation about said longitudinal axis, said second rotor assembly having a connecting portion located substantially said predetermined radial distance from said second axis, a second end of said second link being rotatably coupled to said connecting portion of said second rotor assembly, each of said first and second rotor assembles including at least one pair of diametrically opposed pistons disposed within a working chamber having inlet and exhaust ports, each said pair of pistons being rotatably with an associated rotor assembly and said pairs of pistons dividing said working chamber into a plurality of diametrically opposed sub-chambers, and bearing structure for rotatably supporting said first and second rotor assemblies, whereby, as said crankshaft structure rotates at a constant speed, said main crank assembly rotates in one direction about said main crank assembly axis while moving about said longitudinal axis in a direction opposites said one direction, and said crank arm portion rotates about said second axis common with said longitudinal axis in a direction opposite said one direction, thereby causing respective connecting locations of said crank member to be disposed at periodically variable radial distances with respect to said longitudinal axis, which in turn causes rotation of said pistons in the same direction at recurrently variable speeds whereby at least one pair of diametrically opposite sub-chambers decrease in volume while at least one other pair of diametrically opposed sub-chambers increase in volume, and for each complete revolution of said pairs of diametrically opposed pistons, a plurality of operating cycles being completed including successive power, exhaust, intake and compression phases, said second rotor assembly comprising a body in the form of a generally cylindrical drum, said pistons of said second rotor assembly being fixed to an internal portion of said body and wherein said first rotor assembly comprises a generally cylindrical body having a distribution disk coupled to a face thereof, said pistons of said first rotor assembly being fixed to said distribution disk, said body of said first rotor assembly being sized to be received within the internal portion of said body of said second rotor assembly such that each piston of said first rotor assembly cooperates with a piston of said second rotor assembly during rotation of the rotor assemblies, each of said pistons of said first and second rotor assemblies having a plurality of sidewalls joined to define the internal volume.

30. The internal combustion rotary engine according to claim 29, wherein each of said pistons of said first and second rotor assemblies has a plurality of sidewalls joined to define an internal volume.

31. The internal combustion rotary engine according to claim 29, wherein said channels are in communication with a port that extends through the internal volume of each of said pistons of said second rotor assembly, said port being in communication with a passage to return the liquid to the liquid source.

32. An internal combustion rotary engine comprising:

a housing, a rotor including an outer rotor assembly mounted for rotation within the housing about an axis of the housing, said outer rotor assembly having an internal volume, said outer rotor assembly including a piston assembly comprising at least one pair of diametrically opposed pistons within the internal volume mounted to rotate with the outer rotor assembly, and an inner rotor assembly disposed within internal volume of said outer rotor assembly and mounted so as to rotate with respect to said outer rotor assembly, said inner rotor assembly including a piston assembly comprising at least one pair of diametrically opposed pistons mounted for rotation with the inner rotor assembly, said pistons of said inner and outer rotor assemblies dividing the internal volume into a plurality of pairs of diametrically opposed sub-chambers, said rotor including said rotor assemblies being rotatable without contacting an inner surface of said housing, being provided with water means, and being provided with lubricating means and a mechanism including crankshaft and gear structure and linkages for interconnecting said inner and outer rotor assemblies for rotation of said inner and outer piston assemblies in the same direction at recurrently variable speeds, whereby at least one pair of diametrically opposite sub-chambers decrease in volume while at least one other pair of diametrically opposed sub-chambers increase in volume, and for each complete revolution while at least one other pair of diametrically opposed sub-chambers increase in volume, and for each complete revolution of said pairs of diametrically opposed pistons, a plurality of operating cycles being completed including successive power, exhaust, intake and compression phases, said mechanism being constructed and arranged such that reaction forces generated during an operating cycle are substantially taken-up by said linkages, and a manifold fixed to said housing and having an axis aligned with said housing axis so that said rotor assemblies rotate around said manifold, said manifold having at least one intake port and at least one exhaust port, each of said ports being in periodic communication with said sub-chambers upon rotation of said rotor assemblies, said manifold also having at least one liquid inlet port and at least one liquid return port so as to form a part a liquid cooling distribution structure.

33. An internal combustion rotary engine comprising:

a housing, crankshaft structure having a longitudinal axis and mounted for rotation with respect to said housing about said longitudinal axis, a stationary gear fixed with respect to said housing and axially aligned with said longitudinal axis, a first satellite gear having an axis and being coupled to said crankshaft structure for rotational movement about said axis of the first satellite gear, said first satellite gear axis being spaced from said longitudinal axis, said first satellite gear operatively associated with said stationary gear so as to move about said longitudinal axis, a second satellite gear coaxial with said first satellite gear so as to rotate in the same direction as said first satellite gear and to move with said first satellite gear about said longitudinal axis, a main crank assembly having an axis and being operatively associated with said crankshaft structure for rotational movement with respect thereto and being mounted for rotational movement about the axis of the main crank assembly, said main crank assembly axis being spaced from said longitudinal axis, said main crank assembly including a main gear operatively associated with said second satellite gear, said main crank assembly including a crank member operatively coupled with said main gear and having diametrically opposed connection locations, each connection location being oriented substantially an equal radial distance from said axis of said main crank assembly, first and second links each having one end rotatably coupled to said crank member at an associated connection location, said links having substantially the same length, a rotor including a first rotor assembly mounted for rotation with respect to a crank arm portion of said crankshaft structure about said longitudinal axis of said crankshaft structure, said crank arm portion being operatively associated with said main crank assembly so as to rotate about said main crank assembly axis and said crank arm portion having a second rotational axis spaced from said main crank assembly axis and aligned with said longitudinal axis of said crankshaft structure, said first rotor assembly having a connecting portion located a predetermined radial distance from said second rotational axis, a second end of said first link being rotatably coupled to said connecting portion, and a second rotor assembly oriented concentrically with said first rotor assembly and mounted for rotation about said longitudinal axis, said second rotor assembly having a connecting portion located substantially said predetermined radial distance from said second axis, a second end of said second link being rotatably coupled to said connecting portion of said second rotor assembly, said rotor including said rotor assemblies being rotatable without contacting an inner surface of said housing, being provided with water cooling means, and being provided with lubricating means each of said first and second rotor assembles including at least one pair of diametrically opposed pistons disposed within a working chamber having inlet and exhaust ports, each said pair of pistons being rotatable with an associated rotor assembly and said pairs of pistons dividing said working chamber into a plurality of diametrically opposed sub-chambers, and bearing structure for rotatably supporting said first and second rotor assemblies, whereby, as said crankshaft structure rotates at a constant speed, said main crank assembly rotates in one direction about said main crank assembly axis while moving about said longitudinal axis in a direction opposite said one direction, and said crank arm portion rotates about said second axis common with said longitudinal axis in a direction opposite said one direction, thereby causing respective connecting locations of said crank member to be disposed at periodically variable radial distances with respect to said longitudinal axis, which in turn causes rotation of said pistons in the same direction at recurrently variable speeds whereby at least one pair of diametrically opposite sub-chambers decrease in volume while at least one other pair of diametrically opposed sub-chambers increase in volume, and for each complete revolution of said pairs of diametrically opposed pistons, a plurality of operating cycles being completed including successive power, exhaust, intake and compression phases.

34. The internal combustion rotary engine according to claim 33, wherein a recess is provided in opposing sidewalls of each of said pistons.

* * * * *